US011131139B2

(12) United States Patent
Cazarez et al.

(10) Patent No.: US 11,131,139 B2
(45) Date of Patent: Sep. 28, 2021

(54) END CAP ARRANGEMENTS FOR COMPOSITE DOOR ASSEMBLY

(71) Applicant: Therma-Tru Corp., Maumee, OH (US)

(72) Inventors: Roy Cazarez, Monclova, OH (US); Seth Gillen, Hamilton, IN (US); Logan Harvey, Angola, IN (US); Charles Spellman, Huntertown, IN (US)

(73) Assignee: THERMA-TRU CORP, Maumee, OH (US)

( * ) Notice: Subject to any disclaimer, the term of this patent is extended or adjusted under 35 U.S.C. 154(b) by 0 days.

(21) Appl. No.: 16/530,250

(22) Filed: Aug. 2, 2019

(65) Prior Publication Data

US 2020/0040647 A1 Feb. 6, 2020

Related U.S. Application Data

(60) Provisional application No. 62/714,259, filed on Aug. 3, 2018.

(51) Int. Cl.

| | |
|---|---|
| ***E06B 3/96*** | (2006.01) |
| ***E06B 3/82*** | (2006.01) |
| ***E06B 3/70*** | (2006.01) |
| ***E06B 3/72*** | (2006.01) |

(52) U.S. Cl.

CPC ..... *E06B 3/9632* (2013.01); *E06B 3/7001* (2013.01); *E06B 3/725* (2013.01); *E06B 3/825* (2013.01)

(58) Field of Classification Search

CPC ..... E06B 3/9632; E06B 3/7001; E06B 3/725
See application file for complete search history.

(56) References Cited

U.S. PATENT DOCUMENTS

| | | | | |
|---|---|---|---|---|
| 1,573,194 A * | 2/1926 | Roe | E06B 9/52 | 160/91 |
| 2,690,214 A * | 9/1954 | Diehl | E06B 9/52 | 160/97 |
| 2,801,688 A * | 8/1957 | Singleton | E06B 3/24 | 160/96 |
| 3,129,278 A * | 4/1964 | Watt, Jr. | H05K 9/0015 | 174/366 |
| 4,068,421 A * | 1/1978 | Marovich | A01G 9/1407 | 52/81.4 |
| 4,152,876 A * | 5/1979 | Seely | E06B 3/825 | 49/503 |

(Continued)

*Primary Examiner* — Paola Agudelo
(74) *Attorney, Agent, or Firm* — Calfee, Halter & Griswold LLP

(57) ABSTRACT

A Dutch door assembly includes first and second door sections, each including a composite door member and an end cap. The composite door member includes a core member disposed between first and second end stiles, together defining a front door surface, a rear door surface, and an end surface, a front door skin secured to and substantially covering the front door surface, and a rear door skin secured to and substantially covering the rear door surface. The end cap includes a cover portion covering the end surface of the composite door member and a retention portion extending from the cover portion into engagement with the core member. The end cap of the first door section includes an abutment portion contoured to engage an abutment portion of the end cap of the second door section when the first and second door sections are in pivoted alignment.

20 Claims, 20 Drawing Sheets

(56) References Cited

U.S. PATENT DOCUMENTS

| | | | | | |
|---|---|---|---|---|---|
| 4,320,161 | A * | 3/1982 | Redman | E06B 7/231 | 428/122 |
| 4,513,555 | A * | 4/1985 | Johnson | E06B 3/721 | 403/205 |
| 4,550,540 | A | 11/1985 | Thorn | | |
| 4,720,951 | A | 1/1988 | Thorn et al. | | |
| 5,230,181 | A * | 7/1993 | Geoffrey | E06B 1/70 | 49/469 |
| 5,231,809 | A * | 8/1993 | Benjamino | B60P 3/32 | 135/117 |
| 5,537,789 | A | 7/1996 | Minke et al. | | |
| 5,718,089 | A * | 2/1998 | Dakin | A63H 33/008 | 446/110 |
| 6,092,343 | A | 7/2000 | West et al. | | |
| 6,619,005 | B1 * | 9/2003 | Chen | E06B 3/5892 | 49/502 |
| 6,702,232 | B2 * | 3/2004 | Dovey | B64C 1/1469 | 244/118.5 |
| 7,886,501 | B2 * | 2/2011 | Bartlett | E06B 3/88 | 52/800.1 |

* cited by examiner

END CAP ARRANGEMENTS FOR COMPOSITE DOOR ASSEMBLY

CROSS-REFERENCE TO RELATED APPLICATION

This application claims priority to and all benefit of U.S. Provisional Patent Application Ser. No. 62/714,259, filed on Aug. 3, 2018 and entitled END CAP FOR COMPOSITE DOOR ASSEMBLY, the entire disclosure of which is incorporated herein by reference.

BACKGROUND

Fiberglass doors comprising fiberglass reinforced compression molded skins have acquired consumer acceptance as a suitable replacement for wood material doors. Manufacture of these door members is known in the art; for example, U.S. Pat. Nos. 4,550,540; 4,720,951; 5,537,789; and 6,092,343, the entire disclosures of which are incorporated herein by reference. Fiberglass doors typically include a door-shaped wooden frame member, a polymeric foam-type core positioned within the frame member, a first fiberglass reinforced compression molded door skin secured to a first side of the frame member, and a second fiberglass reinforced compression molded door skin secured to a second side, opposite the first side, of the frame member. The fiberglass reinforced compression molded door skins are prepared from a molding compound.

SUMMARY OF THE DISCLOSURE

In an exemplary embodiment of the present disclosure, a door assembly includes a composite door member and an end cap. The composite door member includes a core member disposed between first and second end stiles, together defining a front door surface, a rear door surface, and an end surface, a front door skin secured to and substantially covering the front door surface, and a rear door skin secured to and substantially covering the rear door surface. The end cap includes a cover portion covering the end surface of the composite door member and a retention tab extending from the cover portion and inserted between the core member and one of the front and rear door skins.

In another exemplary embodiment of the present disclosure, an end cap for a door assembly includes an elongated cover portion defining a door end engaging interior surface, and first and second spaced retention tab portions extending from the interior surface on first and second lateral sides of the cover portion. The cover portion includes first and second longitudinal end portions extending longitudinally outward of the first and second retention tab portions, and an abutment portion disposed on an outer surface of the cover portion and contoured for abutting engagement with a door engaging element adjacent to the door assembly. The abutment portion comprises at least one of a rounded outer surface and a stepped shoulder portion.

In another exemplary embodiment of the present disclosure, a Dutch door assembly includes first and second door sections, each including a composite door member and an end cap. The composite door member includes a core member disposed between first and second end stiles, together defining a front door surface, a rear door surface, and an end surface, a front door skin secured to and substantially covering the front door surface, and a rear door skin secured to and substantially covering the rear door surface. The end cap includes a cover portion covering the end surface of the composite door member and a retention portion extending from the cover portion into engagement with the core member. The end cap of the first door section includes an abutment portion contoured to engage an abutment portion of the end cap of the second door section when the first and second door sections are in pivoted alignment.

In another exemplary embodiment of the present disclosure, a method of installing an end cap on a composite door is contemplated. In an exemplary method, a composite door member is provided, including a core member disposed between first and second end stiles, together defining a front door surface, a rear door surface, and an end surface, a front door skin secured to and substantially covering the front door surface, and a rear door skin secured to and substantially covering the rear door surface. A first retention tab of the end cap is inserted between the core member and one the front and rear door skins. A cover portion of the end cap is forced into engagement with the end surface of the composite door member.

In another exemplary embodiment of the present disclosure, a method of fabricating a Dutch door assembly is contemplated. In an exemplary method, first and second composite door members are provided, each including a core member disposed between first and second end stiles, together defining a front door surface, a rear door surface, and an end surface, a front door skin secured to and substantially covering the front door surface, and a rear door skin secured to and substantially covering the rear door surface. A first end cap is secured with the end surface of first door member by engaging a retention portion of the first end cap with the core member of the first door member, such that a cover portion of the first end cap covers the end surface of the first door member. A second end cap is secured with the end surface of second door member by engaging a retention portion of the second end cap with the core member of the second door member, such that a cover portion of the second end cap covers the end surface of the second door member. The end cap of the first door section includes an abutment portion contoured to engage an abutment portion of the end cap of the second door section when the first and second door sections are in pivoted alignment.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes exemplary embodiments and is not intended to limit the scope of the claims in any way. Indeed, the invention as claimed is broader than and unlimited by the described embodiments, and the terms used have their full ordinary meaning.

Figure 1:
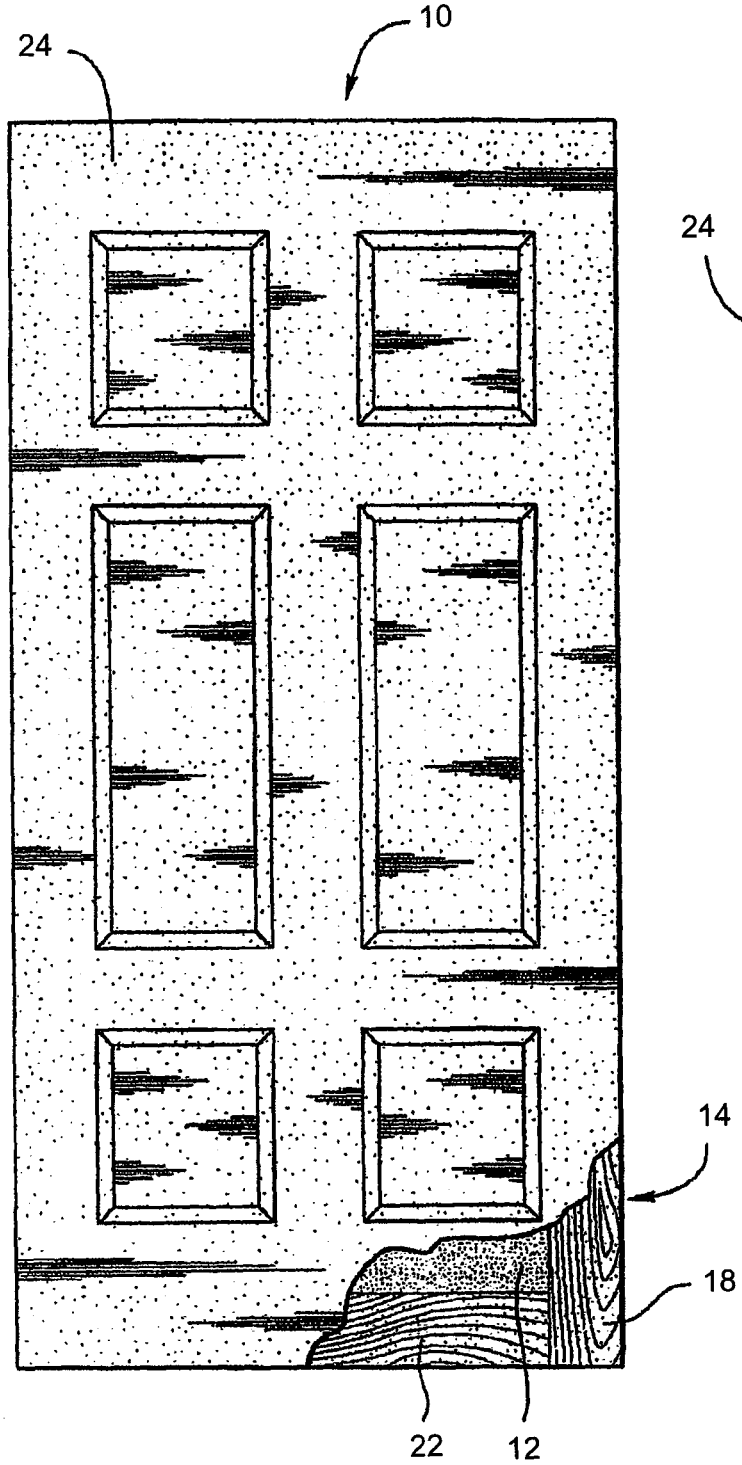
FIG. 1 is a front elevational view of an exemplary door assembly.
Figure 2:
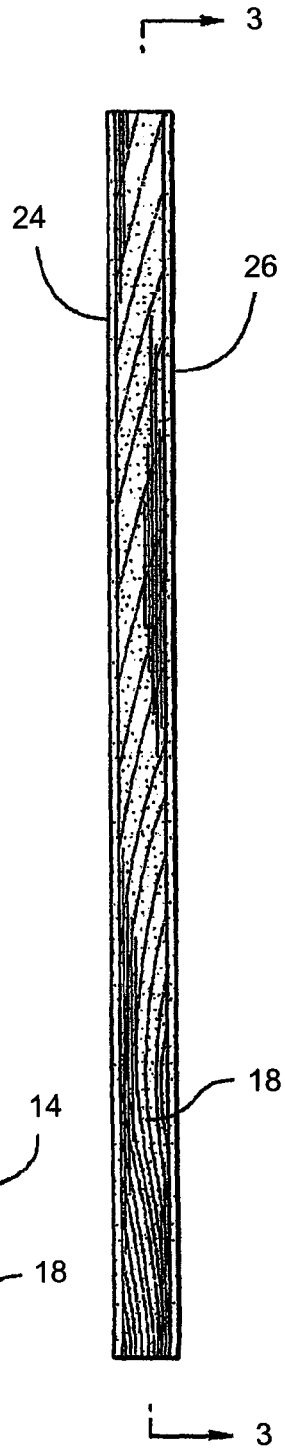
FIG. 2 is a side elevational view of the door assembly of FIG. 1.
Figure 3:
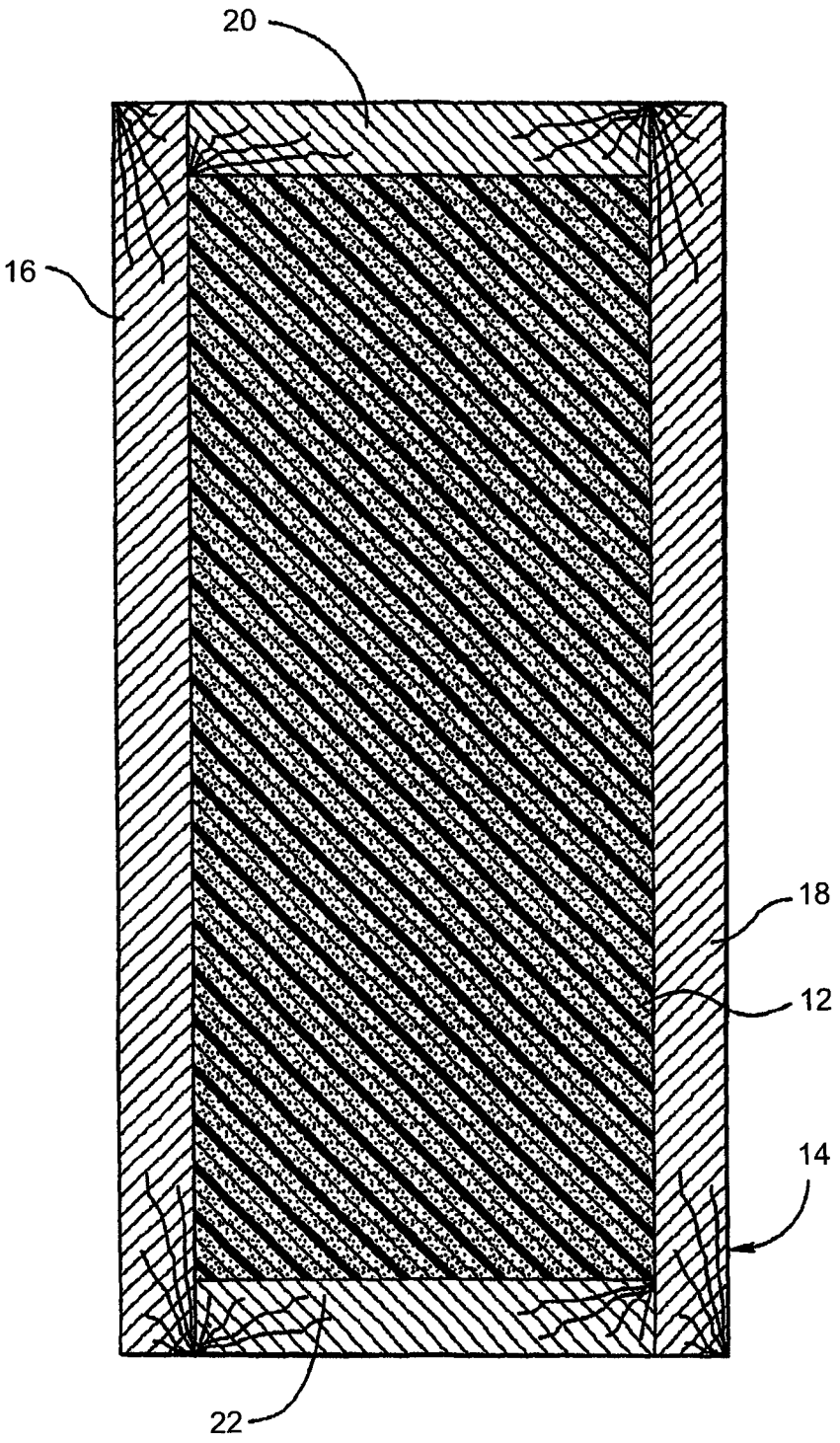
FIG. 3 is a cross-sectional view taken along line 3-3 of FIG. 2 showing the frame of the exemplar door assembly with the core positioned therein.

Referring to FIGS. 1-3, an exemplary door 10 is illustrated. In an exemplary embodiment, the door member is a fiberglass entry way door. The exemplary door 10 includes a core 12 positioned within a frame 14. The core 12 may be an inserted core or a core formed in-situ. The core 12 may be formed from a variety of materials, for example, as suitable for a desired application. For example, inserted cores can include continuous or discontinuous compressed mineral board, compressed inorganic fillers with binders, compressed organic fillers with binders, compressed organic and inorganic blends with binders or in-situ formed binder; molded or shaped thermoplastics such as expanded polystyrene, foamed polyvinyl chloride, or foamed or expanded polyolefins; molded or shaped thermosets such as flexible or rigid, solid or foamed polyurethanes, polyurea-urethanes, polyureas, polyisocyanurates, and phenolics; blow molded shells; or honeycomb inserts comprised of organic fibers, organic pulps, thermoplastics, and thermosets; preforms derived from either air-laid or vacuum-laid mats of cellulosic fiber, glass fiber, thermoplastic fiber, or thermoset fiber or woven mats or veil of the same materials where a binder or resin has been applied or injected to shape a core; and blends or mixtures of these various types of insertable cores. Exemplary in-situ formed cores include cores developed from reaction injection molding with or without reinforcement of thermosets such as polyurethanes, polyureaurethanes, polyisocyanurates, and phenolics; gas injection of a thermoplastic, ceramic, or thermoset; activation of in-situ blowing agents or foaming of material introduced into the shell; mechanical tension applied to melted or softened thermoplastic or thermoset materials; or blends and combinations of these in-situ cores.

As shown in FIG. 3, the exemplary frame 14 includes a first stile 16 and a second stile 18. The stiles 16 and 18 are parallel to one another. The stiles 16 and 18 are positioned in a perpendicular relationship to a first rail 20 and a second rail 22 that is parallel to, and spaced apart from, the first rail 20. The first and second rails 20, 22 extend between and connect the stiles 16 and 18 to form a rectangular geometric configuration. The stiles 16 and 18 and rails 20 and 22 are preferably made of wood but could be made of some other suitable material. The stile 16 can also be a hollow channel of pultruded or extruded reinforced plastic, a metal hollow channel, a partially or totally metal reinforced channel made of a material other than metal, or a compressed mineral stile depending on the application.

As shown in FIGS. 1 and 2, the door 10 includes a first molded skin 24 secured to a first side of the frame 14 and core 12 and a second molded skin 26 secured to a second side of the frame 14 and core 12, for example, by an adhesive.

In some embodiments and applications, a door or door section may be provided without an end rail, such that end portions of the core and stiles are exposed. The door or door section may be fabricated in such a configuration, or may be modified to produce exposed core and stile edges, for example, by cutting off an end portion of the door (e.g., to produce a door having a smaller height), thus removing the end rail, or through fabrication of a Dutch door assembly from a standard compression molded door, by cutting the door into upper and lower sections. The exposed core and stiles may produce an undesirable appearance, or undesirable exposure of the foam core to moisture or other elements.

According to an aspect of the present disclosure, a door assembly may be provided with an end cap installed on at least one of an upper end and a lower end of the door assembly, for example, to cover an exposed portion of a foam core portion of the door, and/or to provide a seal or other such abutment for an adjacent door engaging element, such as, for example, a door sill, upper door frame, or adjacent window or door element, including for example, and adjacent door section in a Dutch door assembly.

Figure 4:
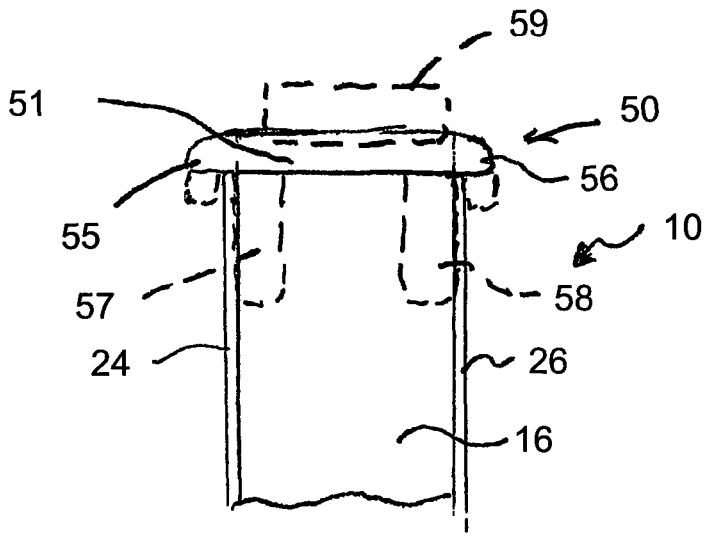
FIG. 4 is a partial side elevational schematic view of an exemplary door assembly having an exemplary end cap assembled therewith.
Figure 5:
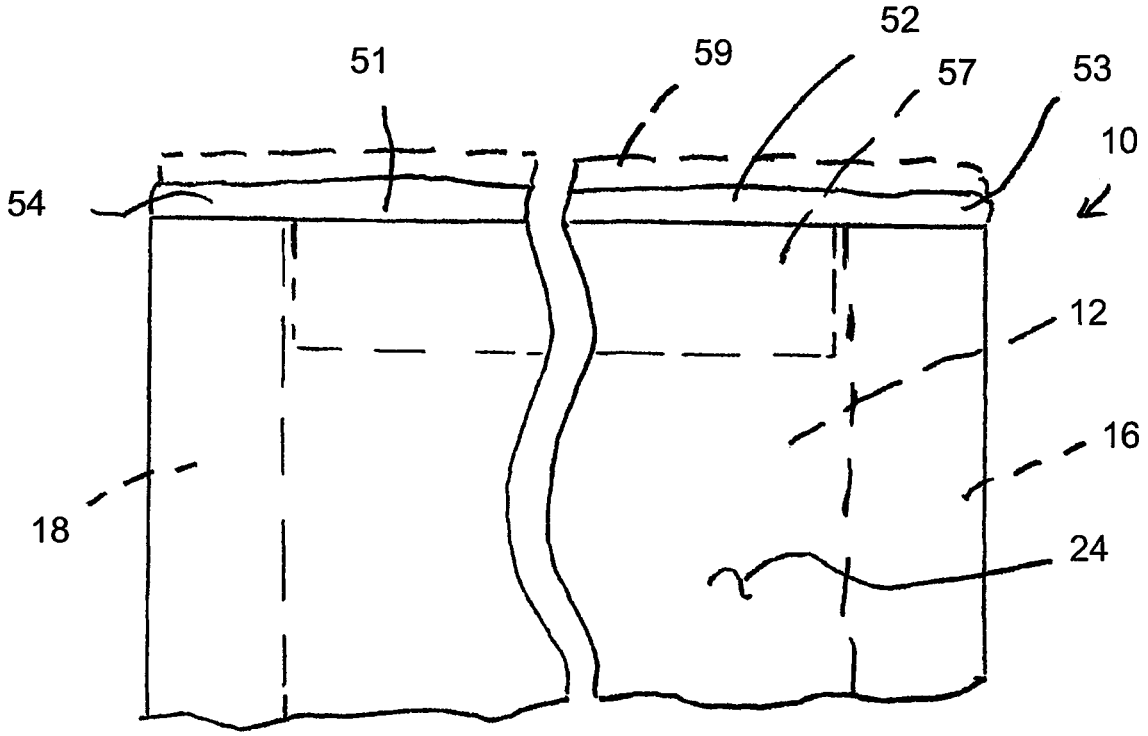
FIG. 5 is a partial front elevational view of the door assembly of FIG. 4.

As schematically shown in FIGS. 4 and 5, to assemble with a door 10 having a door end defined by a core member 12 disposed between end stiles 16, 18 and covered on front and rear sides by adhered door skins 24, 26, an end cap 50 may be provided with an elongated cover portion 51 having a length corresponding to the width of the door 10. Overhang portions 55, 56 may (but need not) be provided at either or both sides of the cover portion, extending beyond the outer surfaces of the door skin(s) 24, 26, for example, to protect the ends of the door skins. At least one retention portion 57, 58 (e.g., one or more tabs) may be positioned on a central portion 52 of the cover portion 51 to align with, and to be inserted into engagement with, the core member 12. As shown, end portions 53, 54 of the cover portion 51 may be provided with substantially planar interior surfaces for abutment with the stiles. The end cap may be dimensioned such that the end portions 53, 54, on which the interlocking portions are not disposed, extend at least the width of the stiles (e.g., at least about 1 inch, or at least about 1.5 inches), to ensure that the retention portions do not engage the relatively harder stiles. The end cap 50 may additionally be provided with an abutment portion, shown schematically at 59, for example, to provide a seal, positive stop, or other such engagement with an adjacent door engaging element.

The end cap 50 may be constructed from a variety of materials, including, for example, a variety of suitable polymers, which may be selected for impact resistance, weather resistance, or other such properties. The end cap 50 may be formed as a compression molded part, or by any other suitable process (e.g., injection molding, extrusion, pultrusion).

The end cap may be provided in many different configurations, with many different combinations of suitable cover portions, side overhang portions, retention portions, and abutment portions. FIGS. 4A-4J and 6-9C illustrate end views of exemplary end caps 50*a*-*h*, 150*a*-*b*, 250*a*-*b*, 350*a*-*b* for use with door ends (e.g., exposed core door ends, as described above).

Figure 4A:
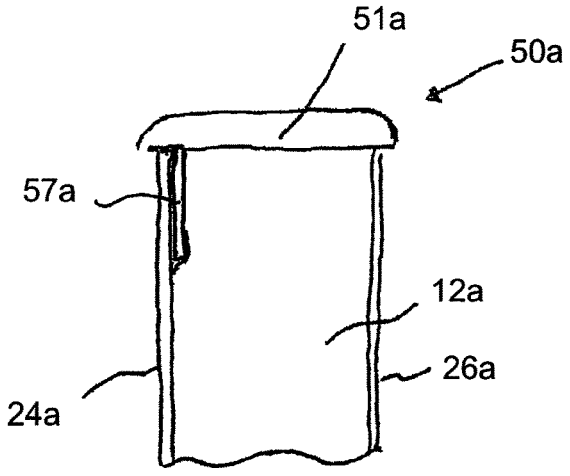
FIGS. 4A-4J include partial side elevational schematic view of exemplary door assemblies having exemplary end caps assembled therewith, the exemplary end caps including a variety of exemplary retention portions.
Figure 4B:
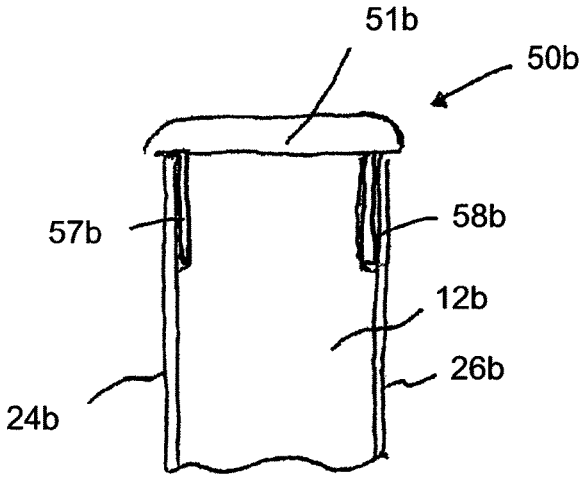

Many different types of retention portions may be provided to facilitate securement of the end cap to the door end. A retention portion may, for example, facilitate alignment of the end cap on the door end and secure the end cap against lateral movement on the door end. As schematically shown in FIG. 4A, one exemplary end cap 50*a* includes a cover portion 51*a* and an alignment tab 57*a* extending from a first lateral side of the cover portion for insertion between the core member 12*a* and the first door skin 24*a* (either the front or rear door skin), thereby aligning the end cap 50*a* on the door end and securing the end cap against lateral movement. In such an arrangement, adhesive between the door end and the interior surface (e.g., applied to either or both of the door end and the interior surface during installation) may facilitate retention of the end cap on the door end (e.g., securing the cap against longitudinal movement and/or vertical detachment from the door end). While the alignment tab 57*a* may vary in size and shape, in some embodiments, the alignment tab may be thin enough for easy insertion between the door skin and core member, and may include a sharp edge to facilitate delamination of the adhered door skin and core member. In another exemplary embodiment, as shown in FIG. 4B, the end cap 50*b* additionally includes a second alignment tab 58*b* extending from a second lateral side of the cover portion 51*b* for insertion between the core member 12*b* and the second door skin 26*b*.

Figure 4C:
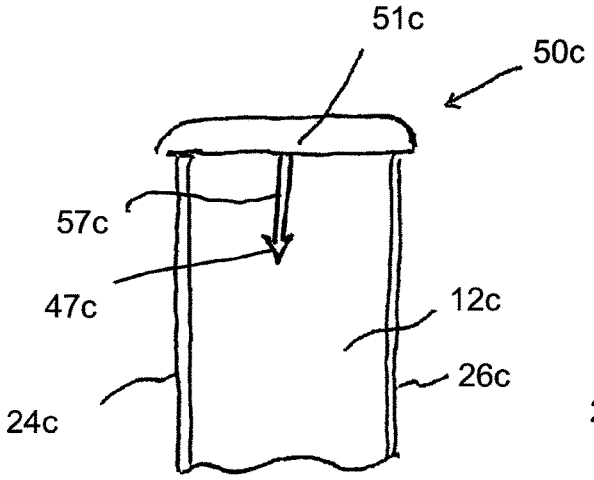
Figure 4D:
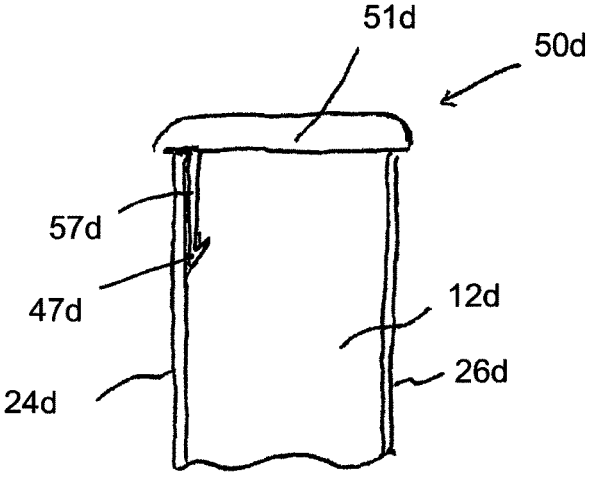

In other embodiments, an end cap may include a retention portion that interlocks with the core member to secure the end cap against longitudinal movement and/or vertical detachment from the door end. As schematically shown in FIG. 4C, one exemplary end cap 50*c* includes a cover portion 51*c* and an interlocking retention tab 57*c* extending from an interior surface of the cover portion for insertion into the core member 12*c* to grip the compressible core member. To that end, the interlocking tab 57*c* may include one or more barbs, anchors, or other such gripping portion 47*c* that gripping engage the core member material (e.g., compressible foam). In such an arrangement, adhesive between the door end and the interior surface (e.g., applied to either or both of the door end and the interior surface during installation) may facilitate retention of the end cap on the door end. While the interlocking tab 57*c* may vary in size and shape, in some embodiments, the alignment tab may include a sharp edge to facilitate piercing insertion into the core member 12*c*, and the gripping portions may be oriented to facilitate piercing insertion while resisting removal (e.g., angled barbed portions as shown in FIGS. 6-9A). In another exemplary embodiment, as shown in FIG. 4D, the end cap 50*d* may include a retention tab 57*d* that is positioned for insertion between the door skin 24*d* and core member 12*d* to function as an alignment tab, and also includes a gripping portion 47*d*, such as a barbed end, to function as an interlocking tab.

Figure 4E:
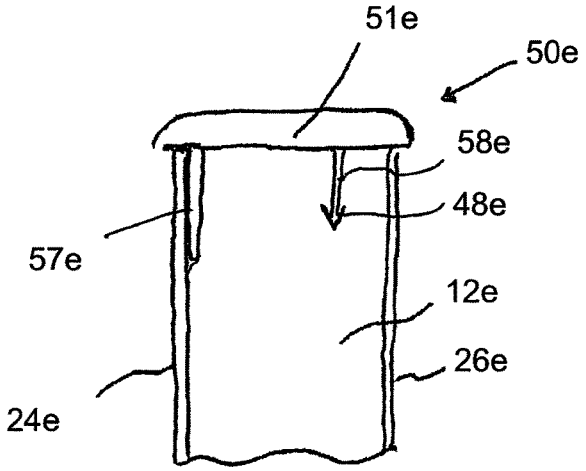
Figure 4F:
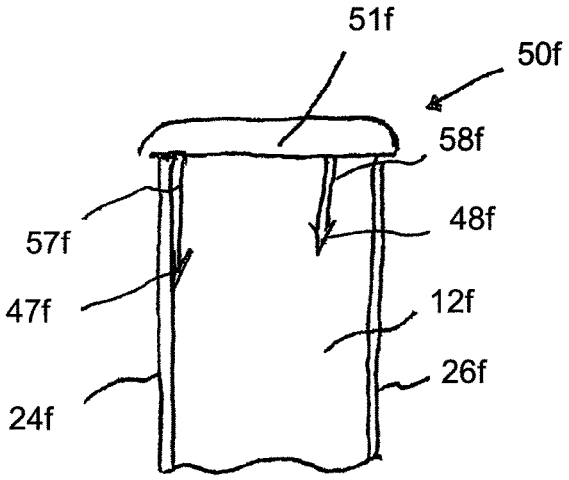
Figure 4G:
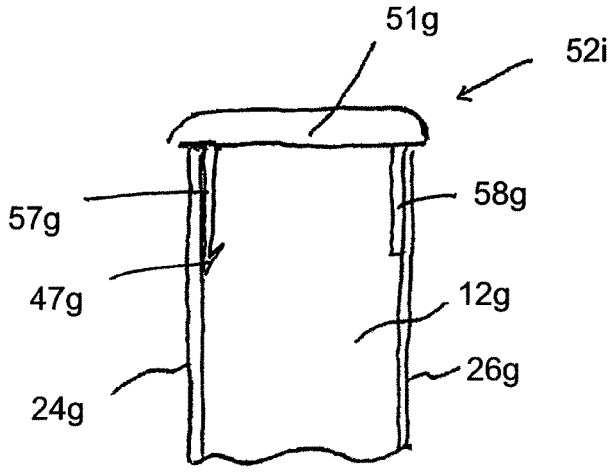
Figure 4H:
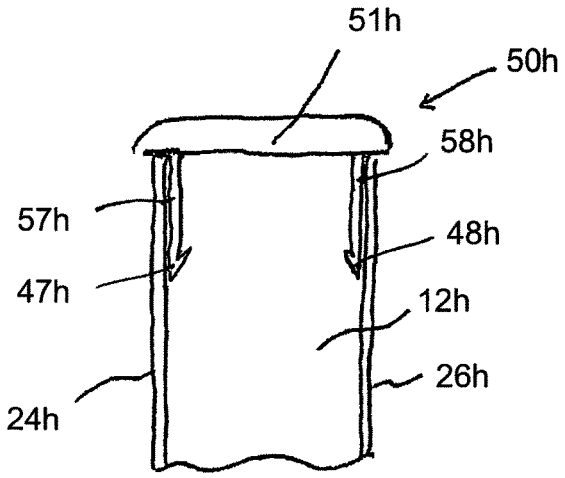

In other exemplary embodiments, an end cap may include first and second retention tabs (or sets of tabs) provided in a variety of combinations. As one example, as shown in FIG. 4E, an end cap 50*e* may include a first or aligning retention tab 57*e* extending from a first lateral side of the cover portion 51*e* for insertion between the core member 12*e* and the first door skin 24*e* (either the front or rear door skin), and a second or interlocking retention tab 58*e* extending from an interior surface of the cover portion 51*e* for insertion into the core member 12*e* with a gripping portion 48*e* for gripping the core member. As another example, as shown in FIG. 4F, an end cap 50*f* may include a first aligning and interlocking retention tab 57*f* extending from a first lateral side of the cover portion 51*f* for insertion between the core member 12*f* and the first door skin 24*f*, with a gripping portion 47*f* for gripping the core member, and a second interlocking retention tab 58*f* extending from an interior surface of the cover portion 51*f* for insertion into the core member 12*f* with a gripping portion 48*f* for gripping the core member. As another example, as shown in FIG. 4G, an end cap 50*g* may include a first aligning and interlocking retention tab 57*g* extending from a first lateral side of the cover portion 51*g* for insertion between the core member 12*g* and the first door skin 24*g*, with a gripping portion 47*g* for gripping the core member, and a second aligning retention tab 58*g* extending from a second lateral side of the cover portion 51*g* for insertion between the core member 12*g* and the second door skin 26*g*. As yet another example, as shown in FIG. 4H, an end cap 50*h* may include a first aligning and interlocking retention tab 57*h* extending from a first lateral side of the cover portion 51*h* for insertion between the core member 12*h* and the first door skin 24*h*, with a gripping portion 47*h* for gripping the core member, and a second aligning and interlocking retention tab 58*h* extending from a second lateral side of the cover portion 51*h* for insertion between the core member 12*h* and the second door skin 26*h*, with a gripping portion 48*h* for gripping the core member.

Figure 4I:
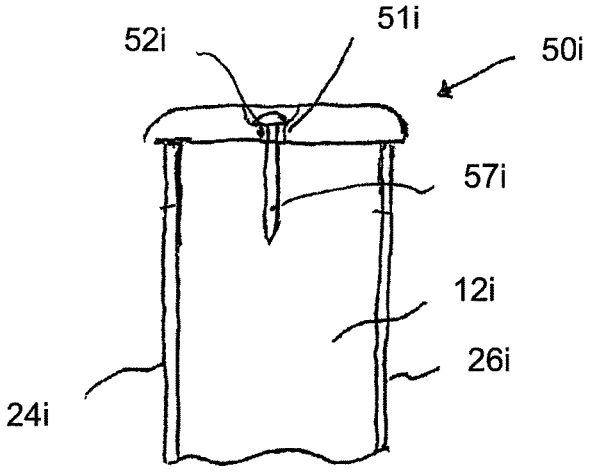
Figure 4J:
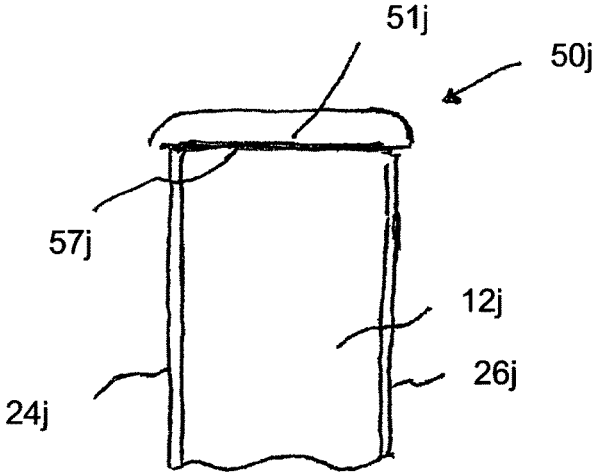

In other arrangements, an end cap may be configured for attachment to a door end without use of retention tabs inserted into the door end. In an exemplary embodiment, as illustrated in FIG. 4I, an end cap 50*i* may be provided with one or more countersunk mounting holes 52*i* disposed in the cover portion 51*i* of the end cap (e.g., spaced apart along the length of the end cap) for receiving fasteners 57*i* (e.g., wood screws) installed in the core member 12*i* of the door end. In another exemplary embodiment, as illustrated in FIG. 4J, an end cap 50*j* may additionally or alternatively be secured to the core member 12*j* of the door end by a layer of glue/adhesive 57*j*.

In the exemplary embodiments of FIGS. 6-9A, barbed retention (e.g., alignment and interlocking) tabs 157*a-b*, 158*a-b*, 257*a-b*, 258*a-b* are disposed on lateral sides of the cover portion 151*a-b*, 251*a-b*, laterally inward of the overhang portions 155*a-b*, 156*a-b*, 255*a-b*, 256*a-b*, and positioned to be inserted between the core member and the corresponding door skin, with a laterally inward oriented barbed gripping portion 147*a-b*, 148*a-b*, 247*a-b*, 248*a-b*, 247*a'-b'*, 248*a'-b'* oriented to grip the core to resist removal of the end cap from the door end. The retention tabs may extend along an entire length of a central portion of the cover portion 151*a-b*, 251*a-b*, 251*a'-b'*, corresponding to substantially the entire width of the core member. Alternatively, sets of discrete, spaced apart retention tabs may be provided on each side of the cover portion. In one exemplary embodiment, a composite door having an internal core portion divided by a vertically extending bracing member, a gap between aligned retention tabs aligns with the incompressible bracing member to facilitate end cap installation. While the end cap may be manufactured to include this gap, in outer arrangement, the installer may cut out a portion of the retention tab to produce the gap.

Figure 12:
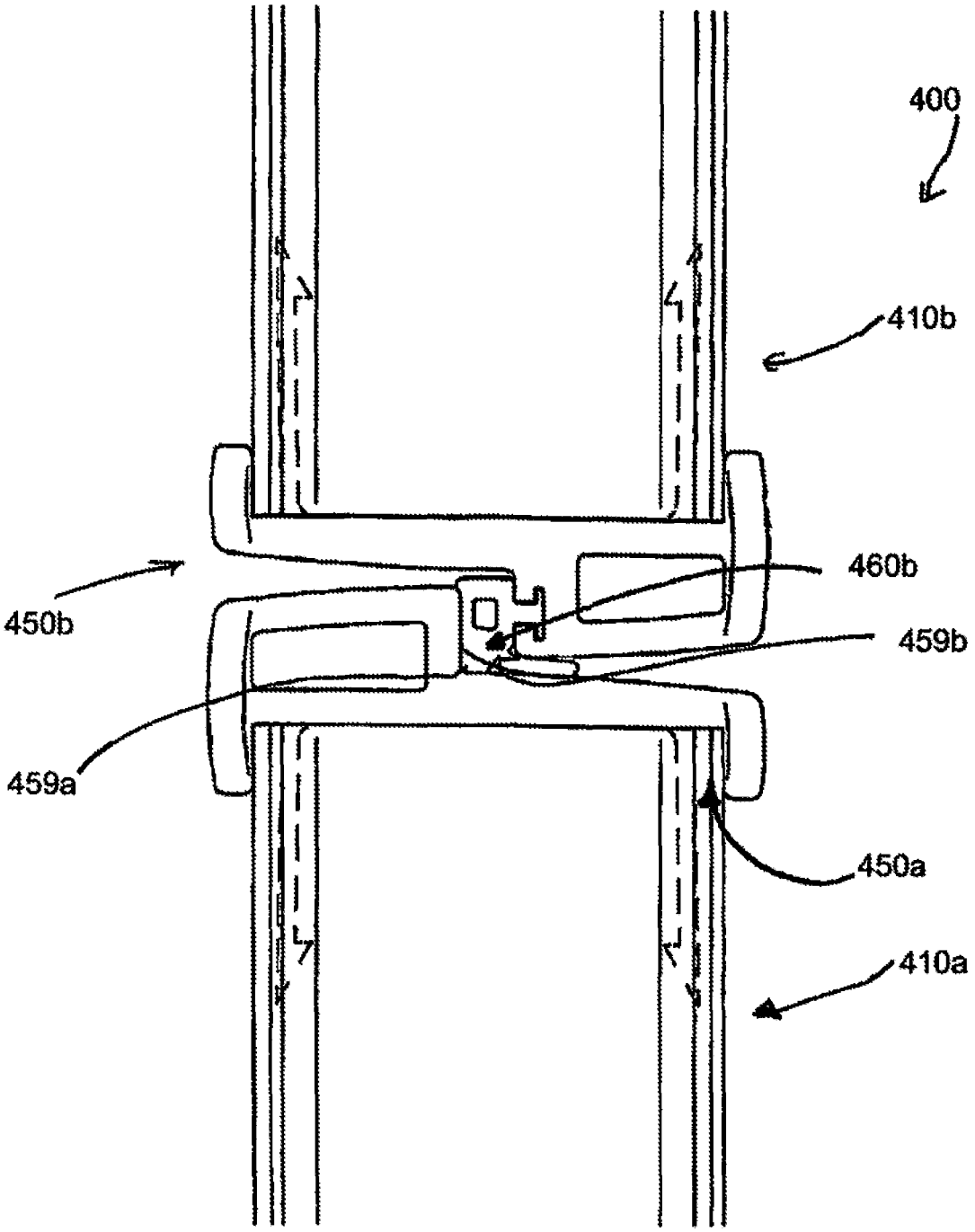
FIG. 12 is a partial side elevational view of another Dutch door assembly including a first door section provided with a first end cap and a second door section provided with a second end cap.
Figure 12A:
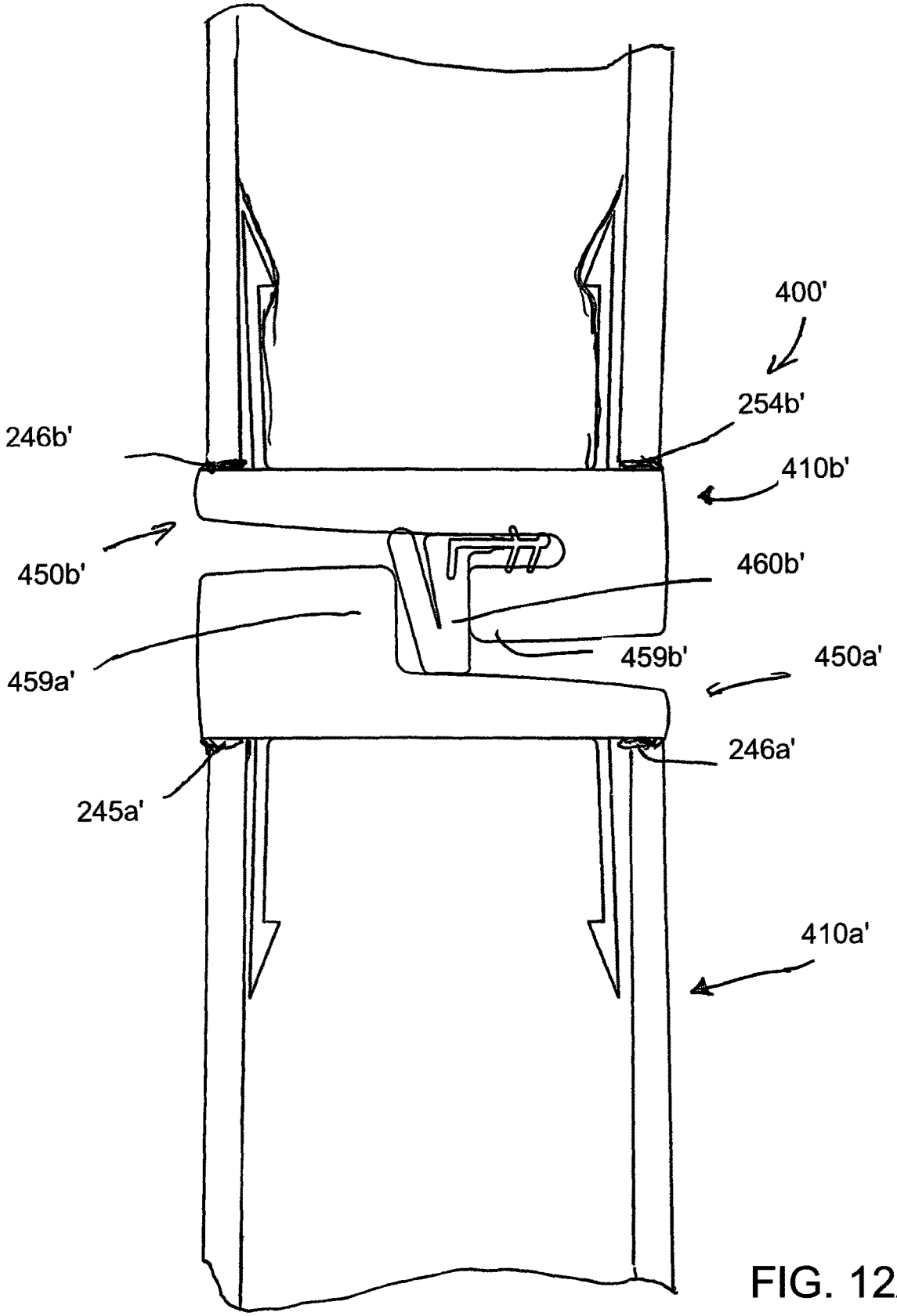
FIG. 12A is a partial side elevational view of another Dutch door assembly including a first door section provided with a first end cap and a second door section provided with a second end cap.
Figure 13:
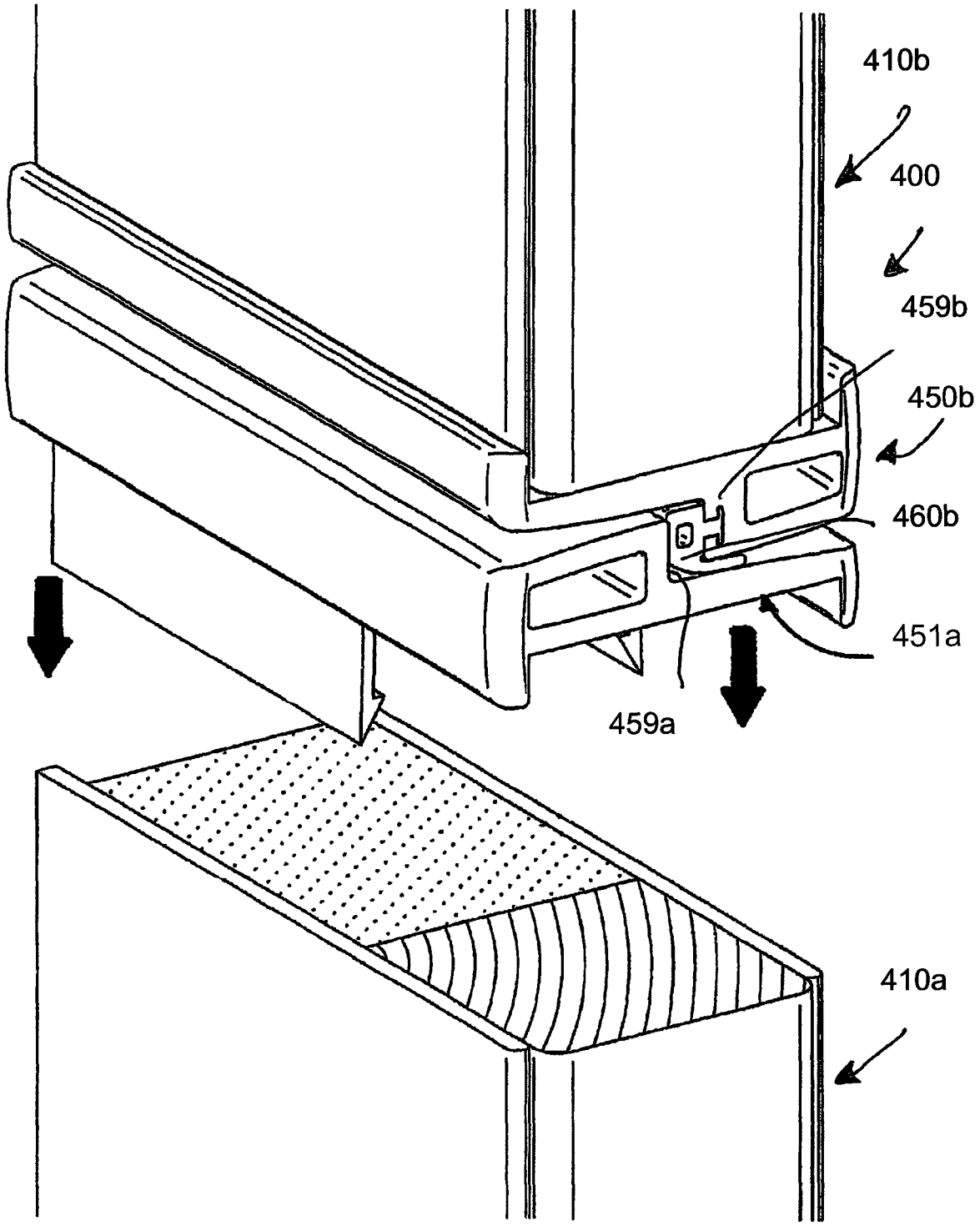
FIG. 13 is a partial front perspective view of the Dutch door assembly of FIG. 12, shown with the first end cap disassembled from the first door section.
Figure 13A:
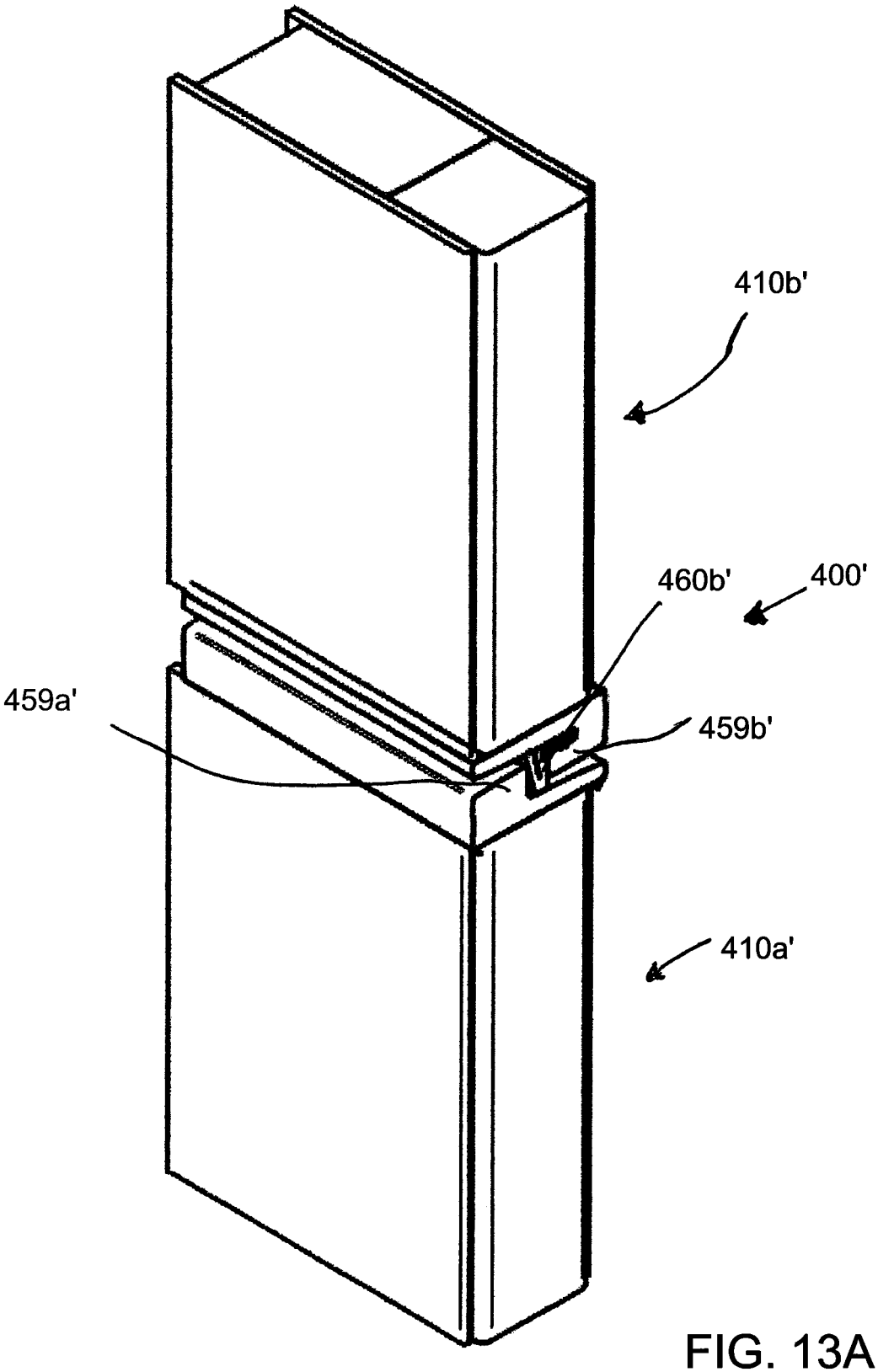
FIG. 13A is a partial front perspective view of the Dutch door assembly of FIG. 12A, shown with the first end cap disassembled from the first door section.

Many different types of end cap side overhang portions may be provided. In one embodiment, as shown, for example, in FIGS. 6 and 7, the end caps 150*a-b* may include side overhang portions 155*a-b*, 156*a-b* that extend laterally outward from the cover portion 151*a-b* a dimension sufficient to extend beyond an outer surface of the door skins, without overlapping the door section ends. In another embodiment, as shown, for example, in FIGS. 8 and 9, the end caps 250*a-b* may include side overhang portions 255*a-b*, 256*a-b* that extend laterally outward and vertically inward from the cover portion 251*a-b* to overlap the door section ends to cover these end portions, for example, to seal the edges of the door skins against moisture. These overhang portions may be sized and dimensioned to accommodate different door thicknesses In other embodiments, either or both lateral sides of the end cap may be provided without an overhang portion, such that the lateral edges of the end cap are substantially flush with the edges of the door skins. In one such embodiment, the interior surface of the end cap may be provided with one or more seal elements for sealing against the door skin edges (e.g., seal the edges of the door skins against moisture). While many different types of seal element may be utilized, FIGS. 8A and 9A illustrate exemplary end caps 250*a'*, 250*b'* including a cover portion 251*a'*, 251*b'* having flexible or compressible fins 245*a'-b'*, 246*a'-b'* extending laterally and vertically inward from the lateral sides of the cover portion. When the end caps end caps 250*a'*, 250*b'* are installed on door ends, the fins 245*a'-b'*, 246*a'-b'* are compressed against the edges of the door skins to effect a seal (see, e.g., FIG. 12A).

Figure 6:
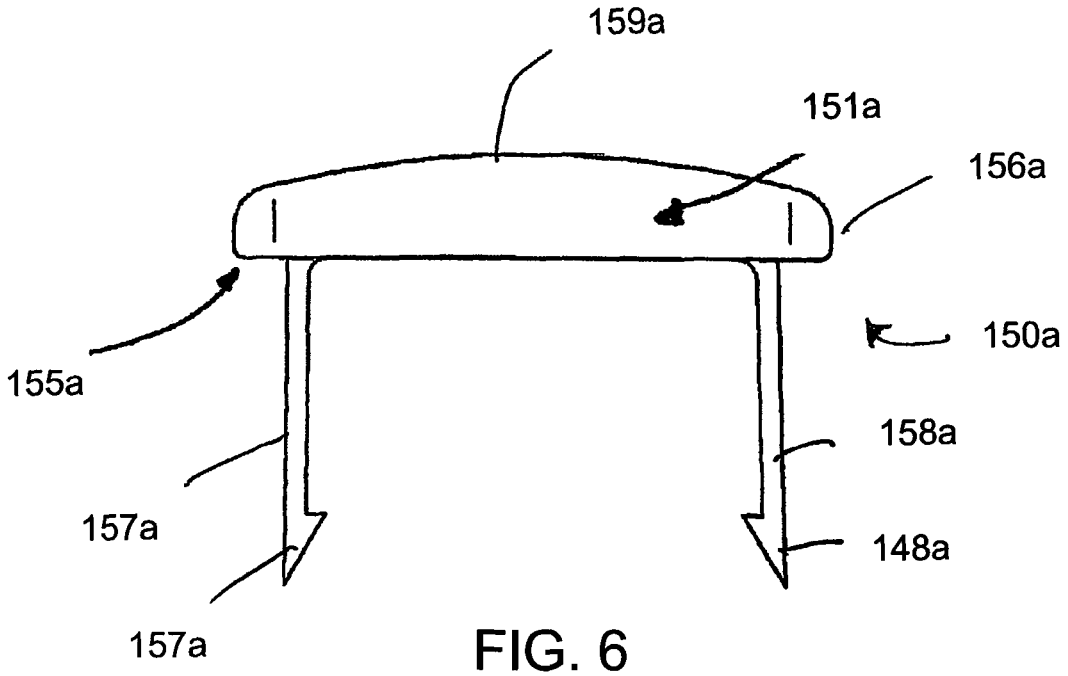
FIG. 6 is a side elevational view of an exemplary end cap.
Figure 7:
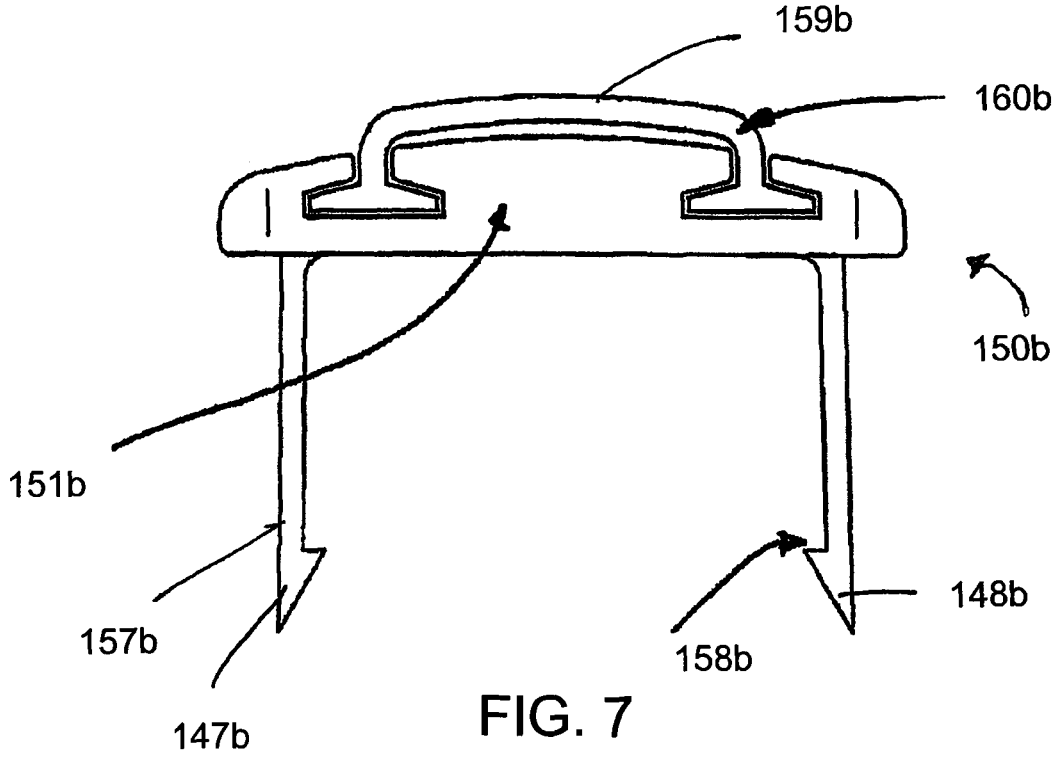
FIG. 7 is a side elevational view of another exemplary end cap.
Figure 7A:
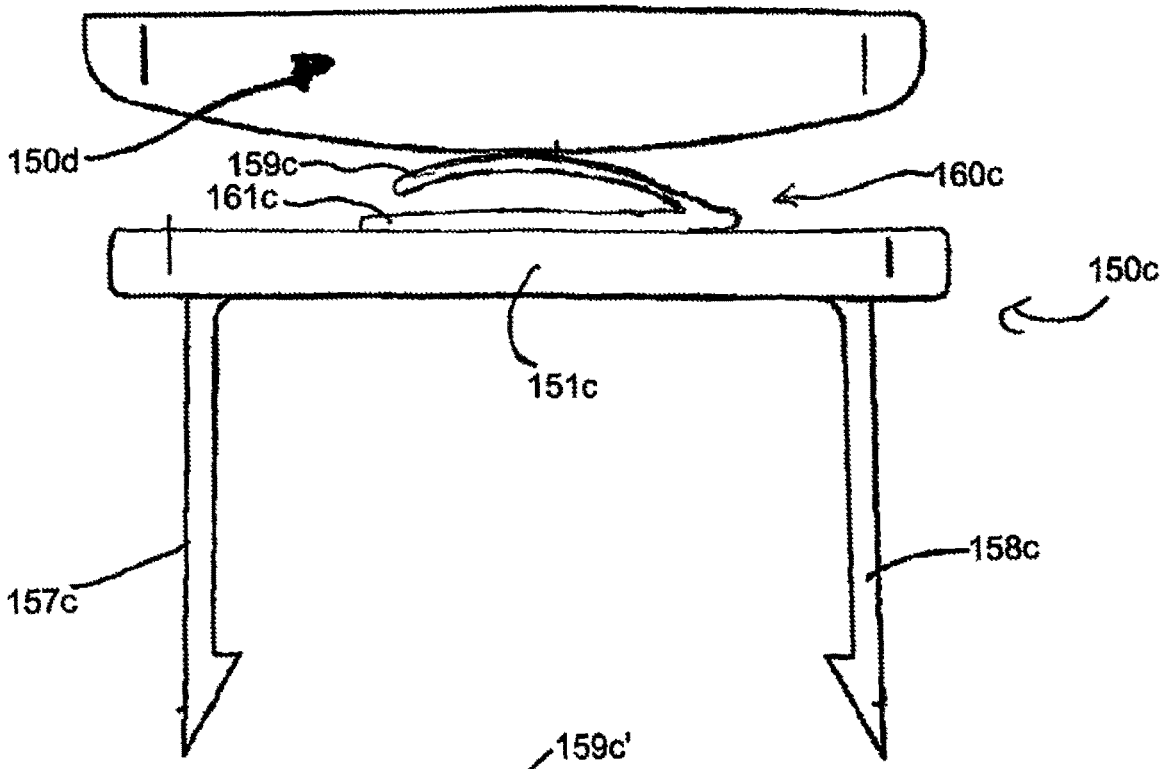
FIG. 7A is a side elevational view of first and second exemplary end caps of a Dutch door assembly.
Figure 7B:
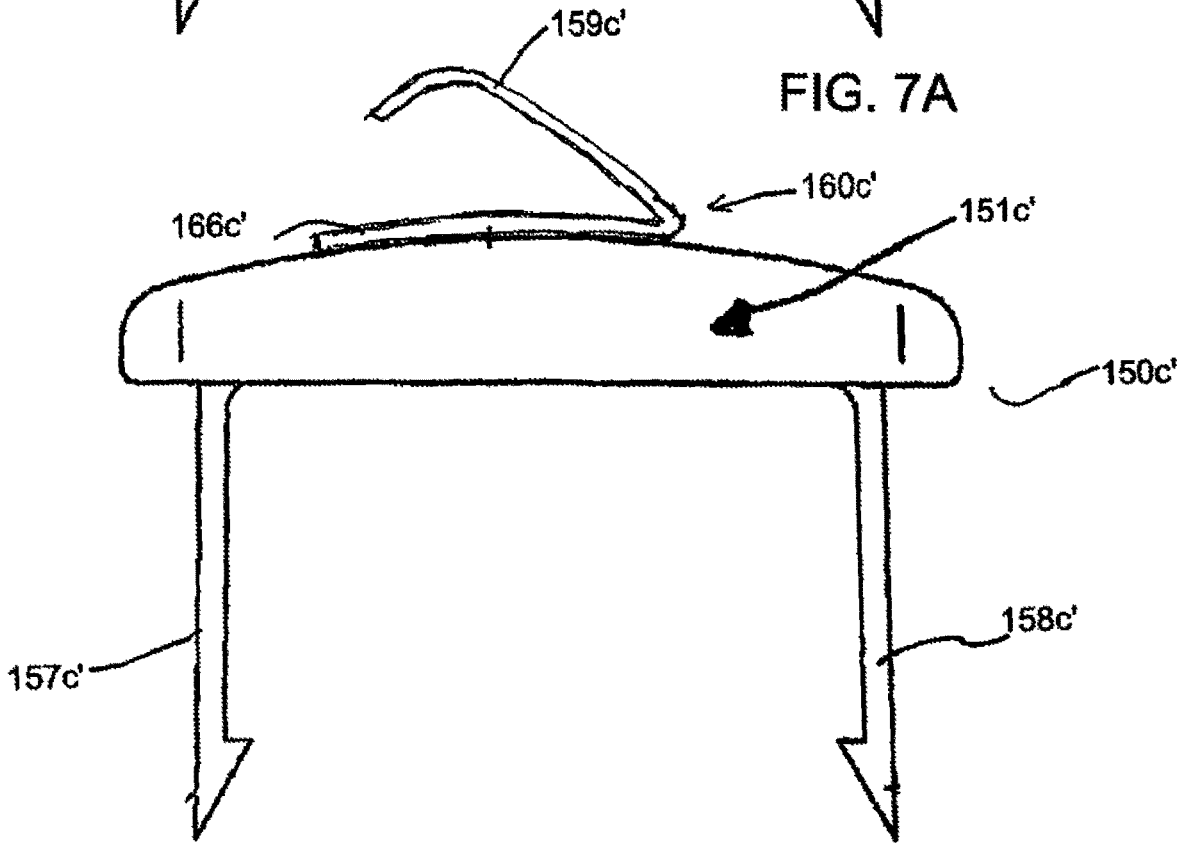
FIG. 7B is a side elevational view of the first end cap of FIG. 7A, with the cantilevered sealing flange in an outwardly biased position.

Many different types of abutment portions may be provided to facilitate sealing and/or positive stop engagement of the door section with a door engaging member. For example, as shown in FIG. 6, the end cap 150*a* may be provided with a contoured (e.g., rounded) outer abutment portion 159*a* for flush outer surface abutment with an adjacent door engaging member. This abutment portion may be substantially rigid, or may be compressible, for example, to facilitate soft and/or sealing engagement with an adjacent door engaging member. In the exemplary embodiment of FIG. 7, the end cap 150*b* is provided with a rounded outer abutment portion 159*b* formed from a soft (e.g., plastic, elastomer, foam) sealing member 160*b* assembled with the cover portion 151*b* of the end cap 150*b*. In the exemplary embodiment, the sealing member 160*b* includes flanged end portions 161*b* that are slidingly received (see, e.g., FIG. 11) in corresponding tracks in the end cap cover portion 151*b*. In another embodiment, as shown in FIGS. 7A and 7B, an end cap 150*c*, 150*c'* includes a resilient weather strip 160*c*, 160*c'* including a base portion 161*c*, 161*c'* secured to the cover portion 151*c*, 151*c'* (which may be flat or contoured, as shown) of the end cap and an outwardly biased cantilevered sealing flange 159*c*, 159*c'* defining a sealing abutment portion for engagement with a cover portion of an adjacent door section end cap 150*d*. The weather strip 160*c*, 160*c'* may be provided in a variety of suitable materials, including, for example, extruded plastic.

Figure 8:
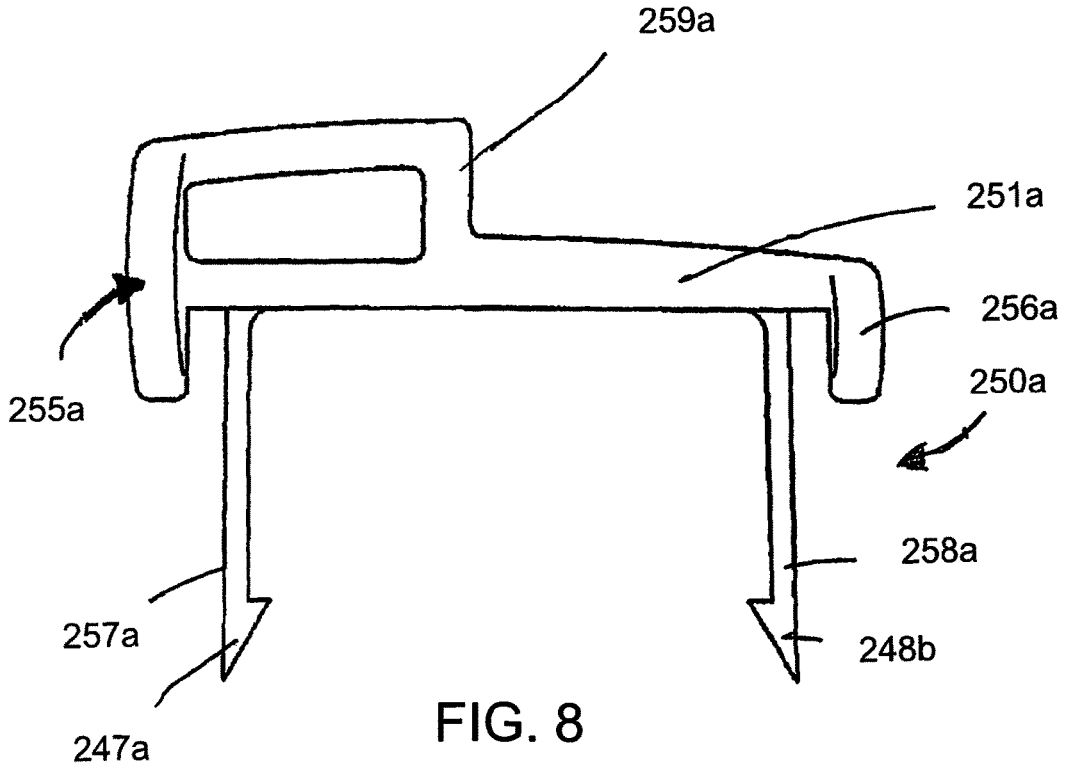
FIG. 8 is a side elevational view of another exemplary end cap.
Figure 9:
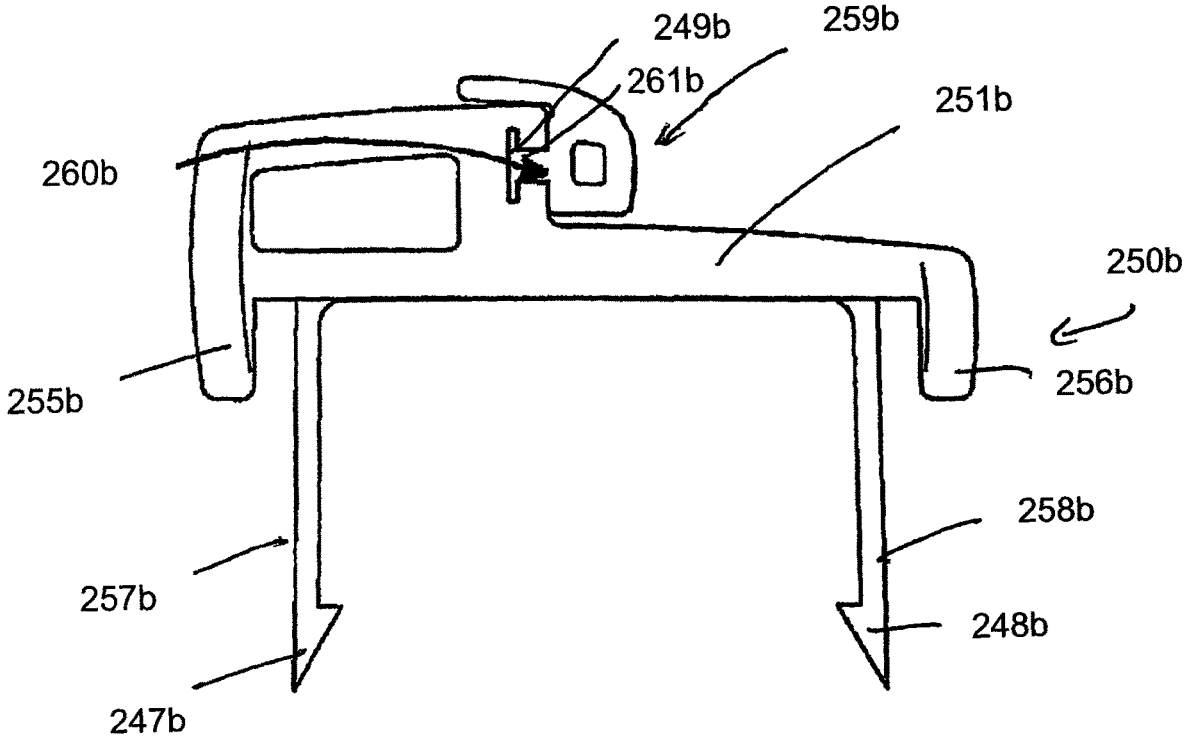
FIG. 9 is a side elevational view of another exemplary end cap.
Figure 8A:
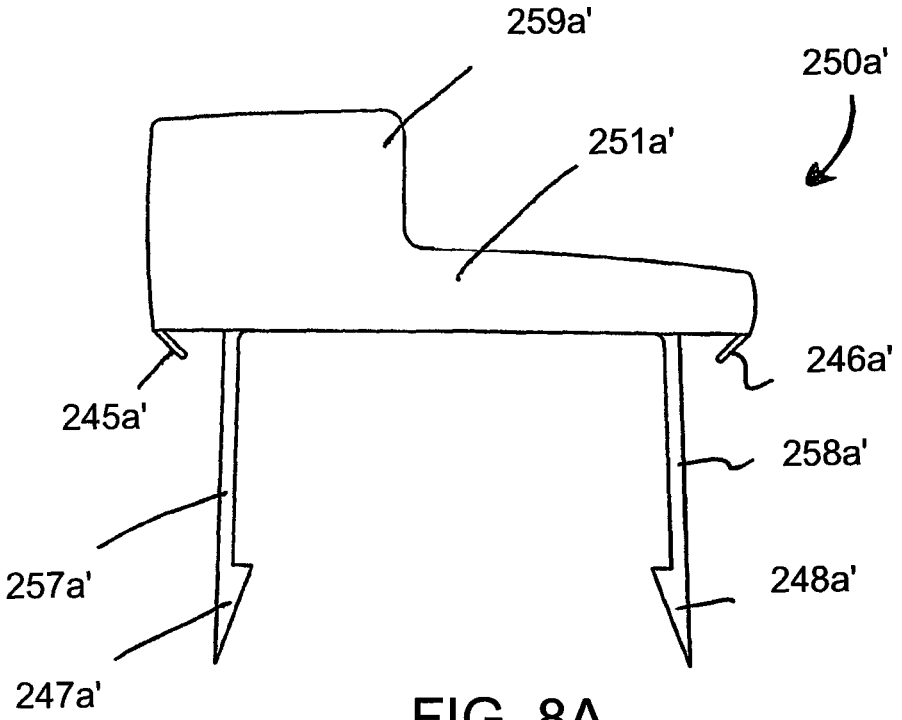
FIG. 8A is a side elevational view of another exemplary end cap.
Figure 9A:
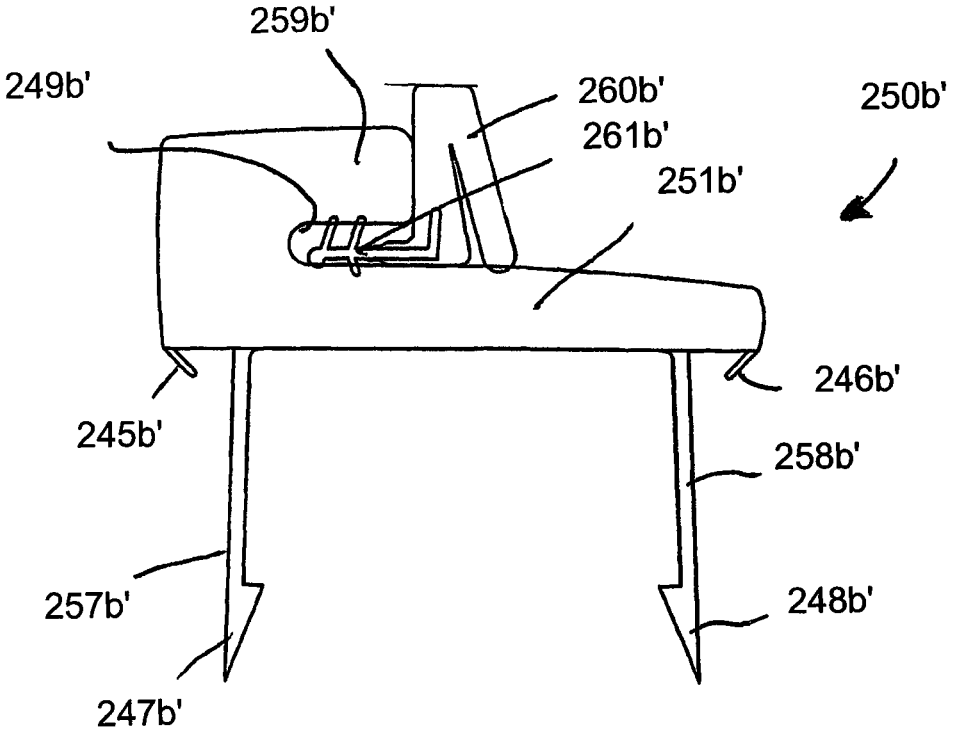
FIG. 9A is a side elevational view of another exemplary end cap.

In the exemplary embodiment of FIG. 8, the end cap 250*a* includes an elongated, stepped shoulder portion 259*a* sized and oriented to provide positive stop abutment with an adjacent door engaging member. This positive stop abutment portion may be substantially rigid, or may be compressible, for example, to facilitate soft and/or sealing engagement with the adjacent door engaging member. As shown, this shoulder portion 259*a* may be hollow in cross section, for example, to reduce material usage or to provide flexibility or compressibility. In other embodiments, as shown, for example, in FIG. 8A, the end cap 250*a'* may include a solid (i.e., non-hollow) shoulder portion 259*a'*. In the exemplary embodiment of FIG. 9, the end cap 250*b* is provided with an abutment portion 259*b* including an elongated gasket 260*b* having a flange portion 261*b* assembled with a keyed slot 249*b* in the stepped shoulder portion 259*b*. In the illustrated embodiment, the sealing member 260*b* is a rabbeted or flanged seal retained in a keyed slot or track 249*b* in the shoulder portion 259*b*, defining side and end abutting surfaces, for example, for an opposed stepped shoulder portion of the adjacent door engaging member. In other embodiments, as shown, for example, in FIG. 9A, the end cap 250*b'* may include an elongated slot 249*b'* that receives an anchor portion 261*b'* of an elongated weatherstrip gasket 260*b'*.

Figure 9B:
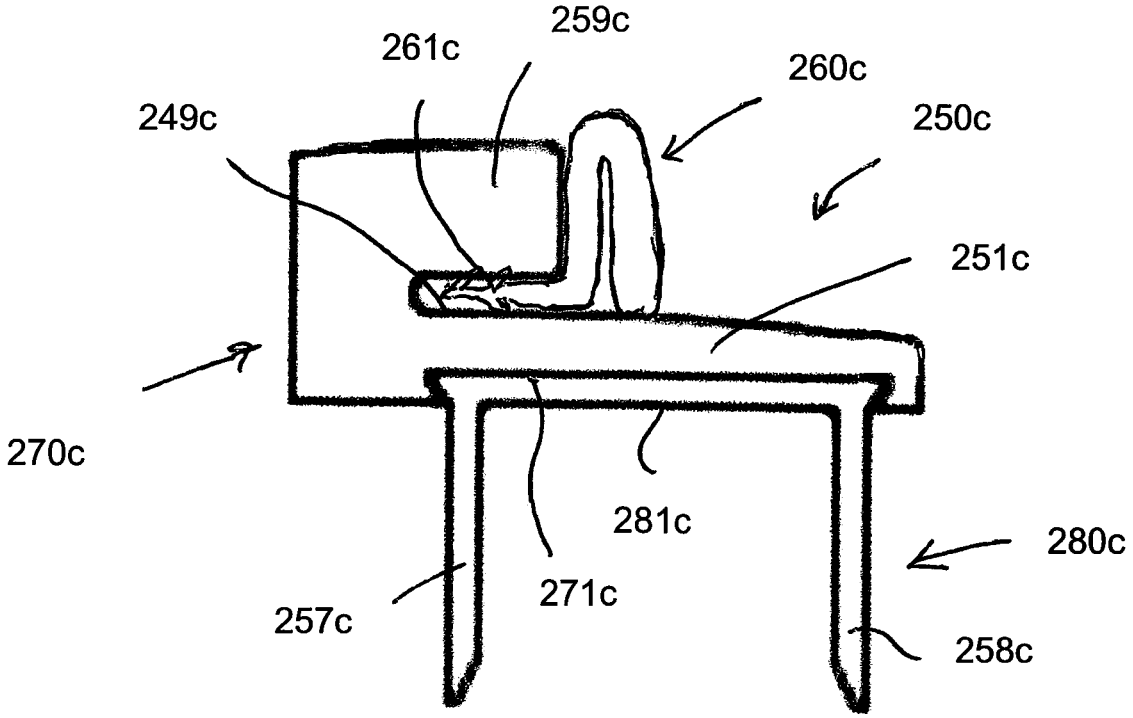
FIG. 9B is a side elevational view of another exemplary end cap.
Figure 9C:
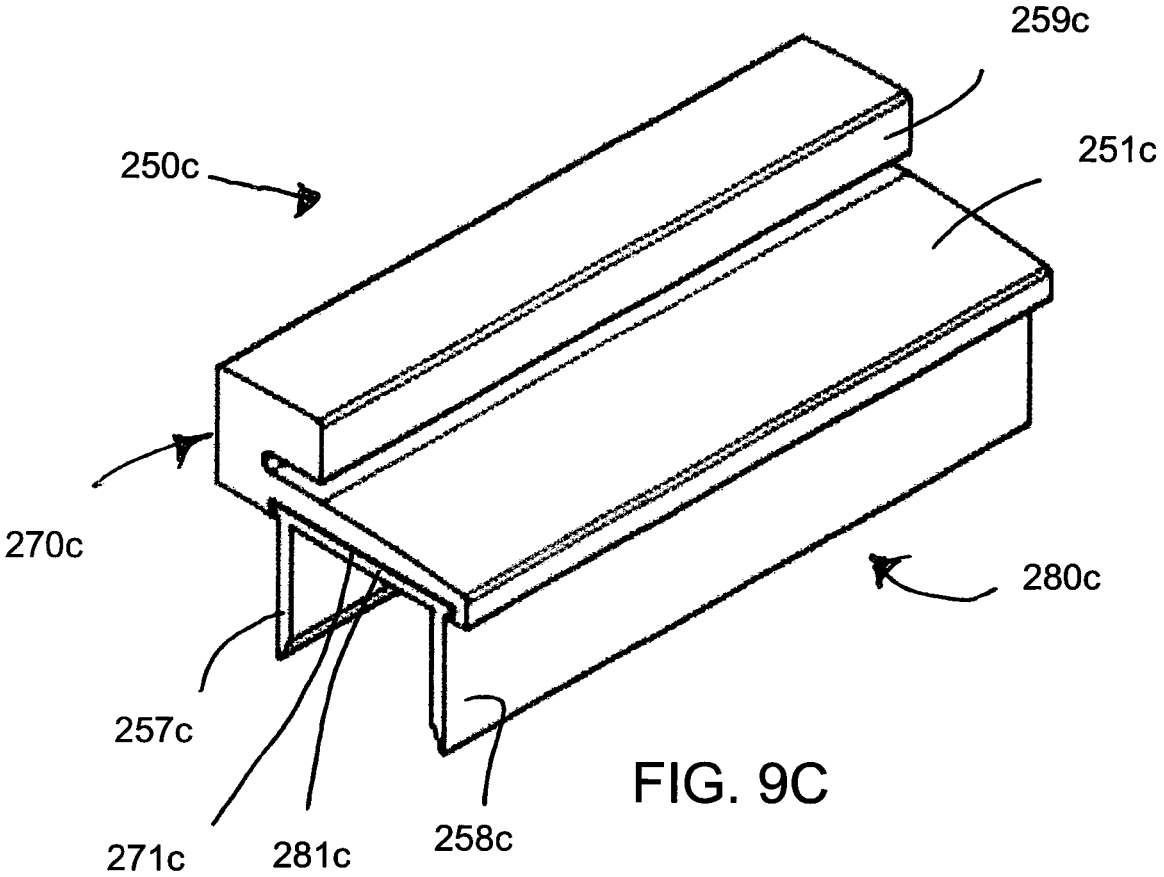
FIG. 9C is a side elevational view of another exemplary end cap.

While the retention tabs may be integral or monolithically formed with the cover portion, as shown in FIGS. 6-9A, in other embodiments, the retention tabs may be disposed on a separate member that is assembled with the cover portion, for example, to facilitate manufacturing, or to allow the retention tabs to be formed from a different (e.g., harder) material than the abutment portion. FIGS. 9B and 9C illustrate an exemplary end caps 250*c* including a cover member 270*c* and a separate retention member 280*c* assembled with the cover member. While any type of cover portion and abutment portion may be provided (e.g., any of the cover and abutment portions described herein), the illustrated cover member 270*c* defines a cover portion 251*c* and abutment portion 259*c* similar to the cover portion and abutment portion of the end cap 250*b'* of FIG. 9A, including an elongated weatherstrip gasket 260*c* having an anchor portion 261*c* that is received in an elongated slot 249*c* of the abutment portion 259*c* of the cover member 270*c*. While any type of retention tabs may be provided (e.g., any of the retention tabs described herein), the illustrated retention member 280*c* includes retention tabs 257*c*, 258*c* positioned to be inserted between the core member and the corresponding door skin. In the illustrated embodiment, the retention tabs 257*c*, 258*c* are disposed on lateral sides of a central slat 281*c* that is secured in a longitudinal groove 271*c* in the cover member 270*c* using, for example, one or more of a glue/adhesive, mechanical fasteners, press fit engagement, interference fit engagement, or interlocking engagement between the cover member and the retention member.

A door assembly including an end cap, such as, for example, any of the end caps 150*a*, 150*b*, 250*a*, 250*b*, 250*a*', 250*b*', 250*c* of FIGS. 6-9C, or any end cap including any one or more of the features described herein, may be arranged for abutment with any number of door engaging members, including, for example, any one or more of a door sill, upper door frame, or adjacent window or door element. In one such embodiment, according to an aspect of the present disclosure, a Dutch door assembly may include upper and lower door sections provided with adjacent end cap members that abut and/or seal with each other when the door halves are both pivoted to an engaging position (e.g., both in the closed position).

Figure 10:
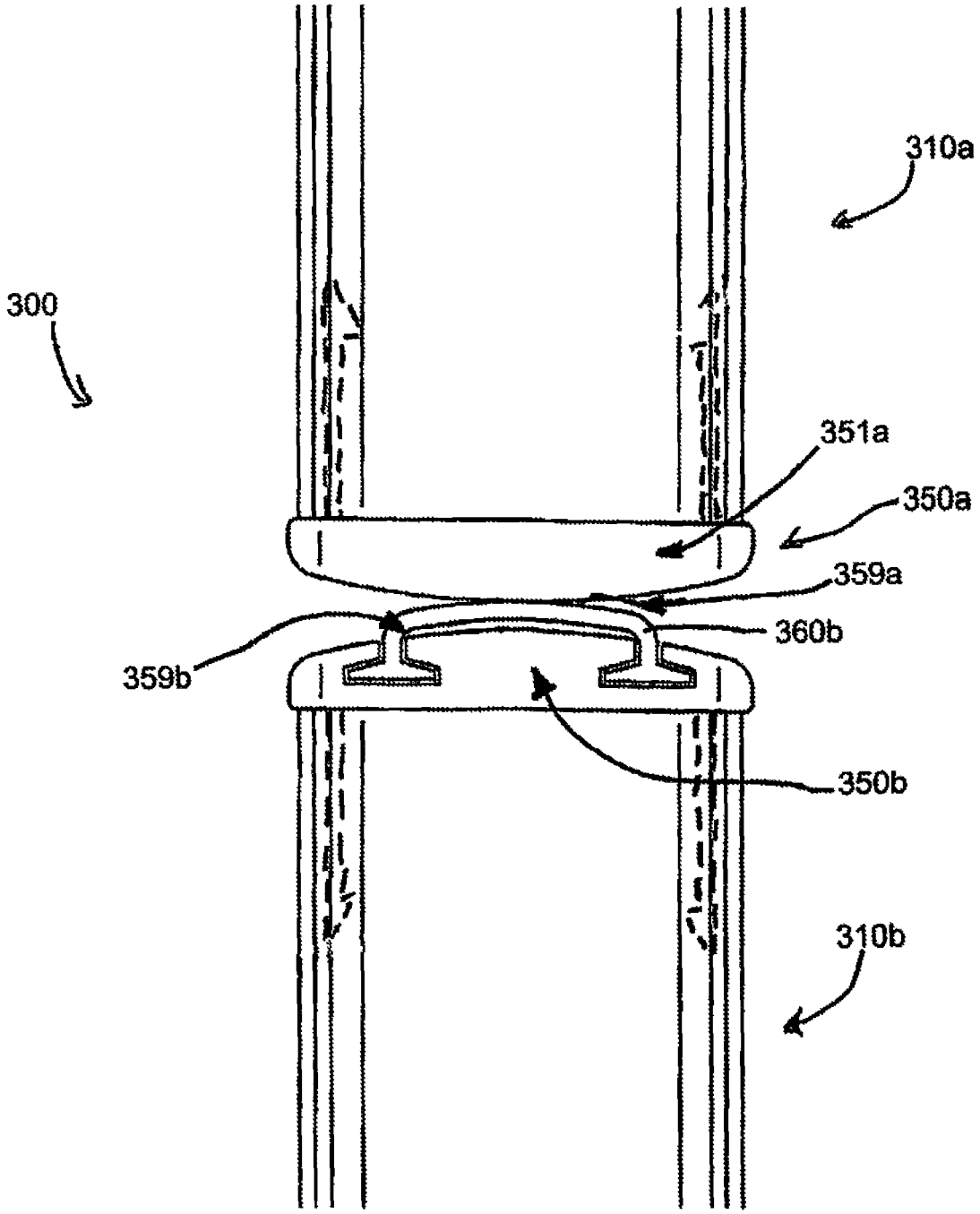
FIG. 10 is a partial side elevational view of a Dutch door assembly including a first door section provided with a first end cap and a second door section provided with a second end cap.
Figure 11:
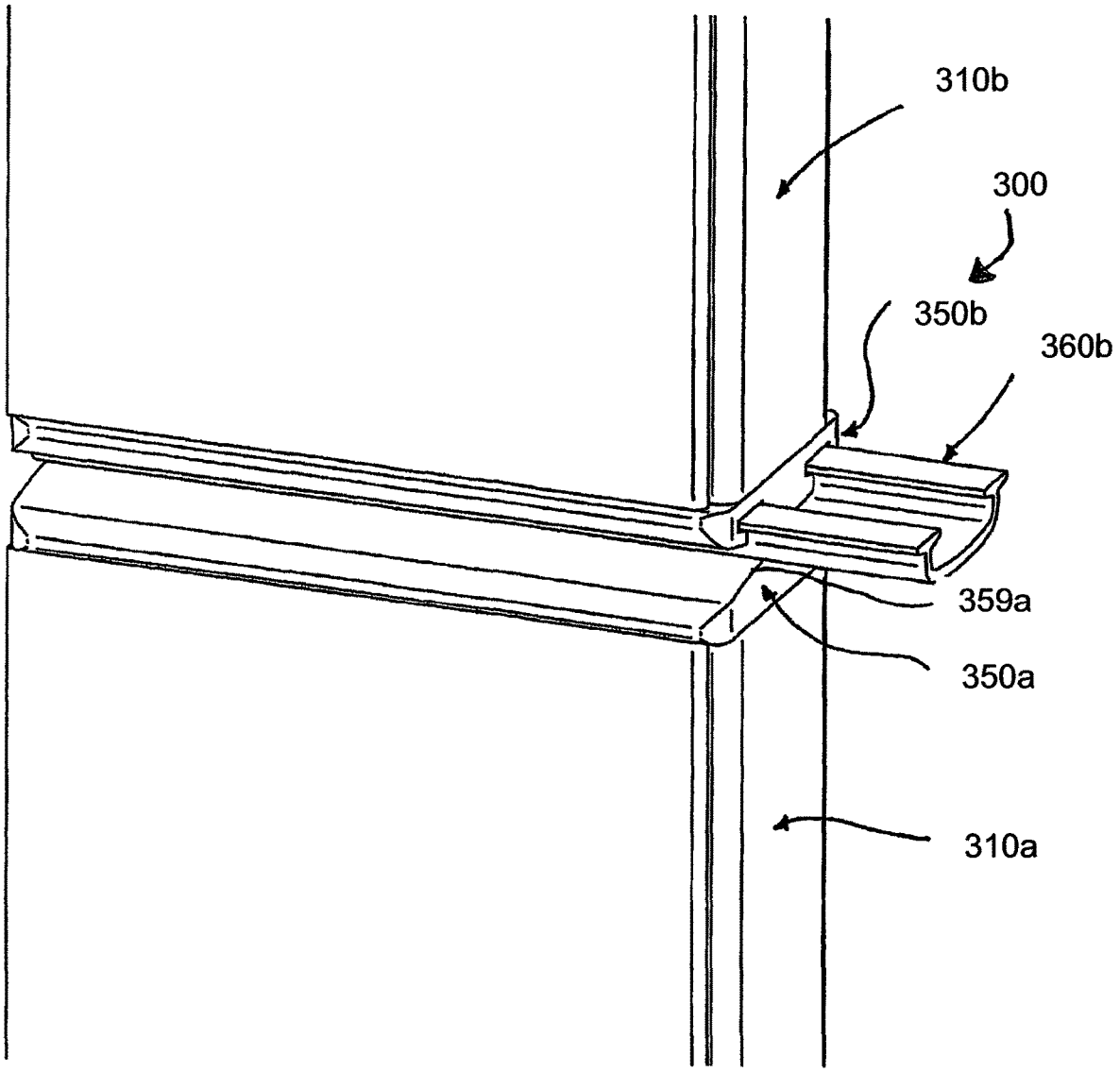
FIG. 11 is a partial front perspective view of the Dutch door assembly of FIG. 10, shown with the seal member of the second end cap in a partially installed position.

While any suitable combination of end caps may be utilized, in one exemplary embodiment of a Dutch door assembly 300, as shown in FIGS. 10 and 11, a first (e.g., upper) door section 310*a* may be provided with an end cap 350*a* including a solid, contoured outer abutment portion 359*a* (e.g., similar to the end cap 150*a* of FIG. 6), and a second (e.g., lower) door section 310*b* may be provided with an end cap 350*b* including a contoured outer abutment portion 359*b* formed from a soft sealing member or gasket 360*b* (e.g., similar to the end cap 150*b* of FIG. 7), for sealing and/or soft retaining engagement of the outer abutment portions 359*a*, 359*b* of the end caps 350*a*, 350*b*. In other exemplary embodiments of a Dutch door assembly 400, 400', as shown in FIGS. 12-13 and 12A-13A, a first (e.g., lower) door section 410*a*, 410*a*' may be provided with an end cap 450*a*, 450*a*' including an elongated shoulder portion 459*a*, 459*a*' (e.g., similar to end caps 250*a* and 250*a*', respectively), and a second (e.g., upper) door section 410*b*, 410*b*' may be provided with an end cap 450*b*, 450*b*' including an abutment portion 459*b*, 459*b*' including an elongated gasket 460*b*, 460*b*' assembled with a shoulder portion (e.g., similar to end caps 250*b* and 250*b*', respectively) facing the shoulder portion 459*a*, 459*a*' of the first end cap 450*a*, 450*a*' for positive stop and sealing engagement between the shoulder portions.

Figure 14:
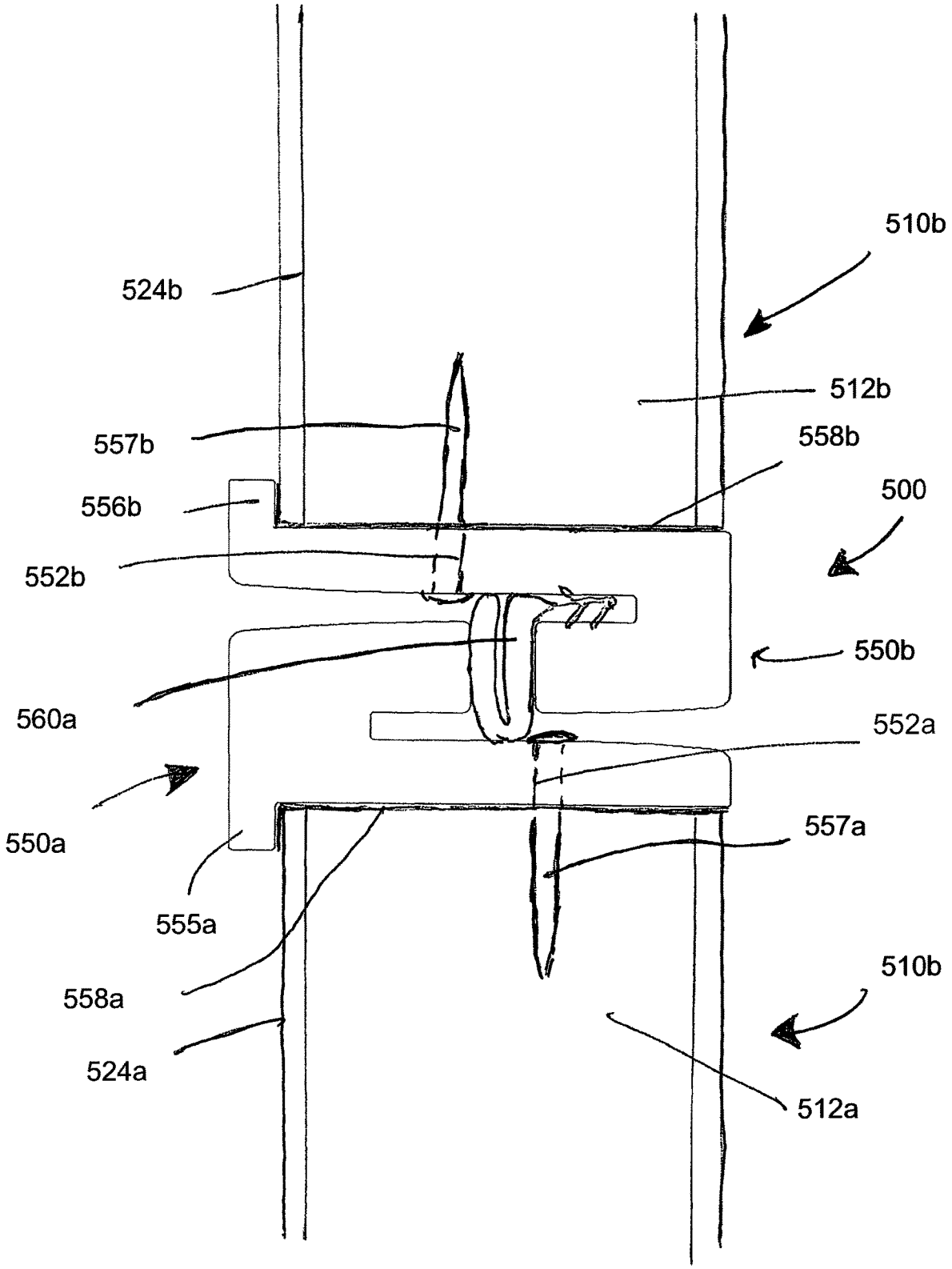
FIG. 14 is a partial side elevational view of another Dutch door assembly including a first door section provided with a first end cap and a second door section provided with a second end cap.
Figure 15:
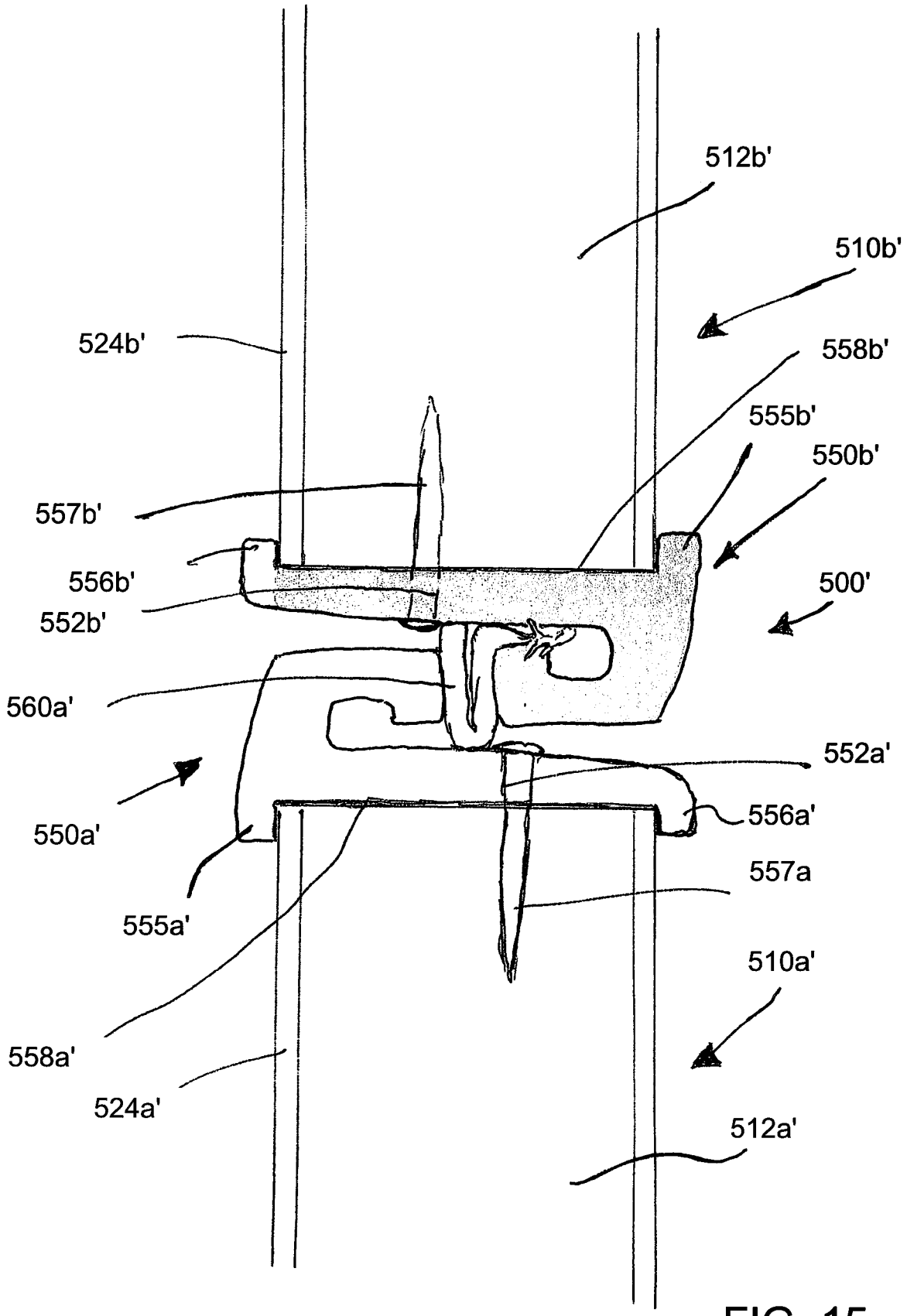
FIG. 15 is a partial side elevational view of another Dutch door assembly including a first door section provided with a first end cap and a second door section provided with a second end cap.

In still other exemplary embodiments of a Dutch door assembly 500, 500', as shown in FIGS. 14 and 15, a first (e.g., lower) door section 510*a*, 510*a*' may be provided with a first end cap 550*a*, 550*a*' secured to the core member 512*a*, 512*a*' by one or more fasteners 557*a*, 557*a*' installed through mounting holes 552*a*, 552*a*' in the cover portion 551*a*, 551*a*' of the first end cap, and a second (e.g., upper) door section 510*b*, 510*b*' may be provided with a second end cap 550*b*, 550*b*' secured to the core member 512*b*, 512*b*' by one or more fasteners 557*b*, 557*b*' installed through mounting holes 552*b*, 552*b*' in the cover portion 551*b*, 551*b*' of the second end cap. The mounting holes 552*a-b*, 552*a*'-*b*' may be positioned such that the fasteners do not interfere with the gasket seals 560*a*, 560*a'*.

In the assembly of FIG. 14, the first and second end caps 550*a*, 550*b* include flanged overhang portions 555*a*, 556*b* abutting the exterior door skins 524*a*, 524*b* to protect the exterior door skin—core member seam from moisture and other contaminants. An adhesive 558*a*, 558*b* may additionally be applied to the door abutting surfaces of the cover portions 551*a*, 551*b* and overhang portions 555*a*, 556*b* to facilitate sealing. In the assembly of FIG. 15, the first and second end caps 550*a*', 550*b*' additionally include flanged overhang portions 556*a*', 555*b*' overlapping the interior door skins 526*a*', 526*b*' to additionally protect the interior door skin—core member seam from moisture and other contaminants. An adhesive 558*a*', 558*b*' may additionally be applied to the door abutting surfaces of the cover portions 551*a*, 551*b* and overhang portions 556*a*', 555*b*' to facilitate sealing. By providing flanged overhang portions on both sides, identical end caps may be provided on both door sections (with the gasket seal 560*a*' being provided with only one of the end caps 550*a*').

In an exemplary method of fabricating a Dutch door assembly, a composite door having a core member disposed between first and second stiles to define a front surface having a front door skin affixed thereto, and a rear surface having a rear door skin affixed thereto is cut across a width of the composite door to form a first door section and a second door section. A thin slice may be removed from an interior end of at least one of the first and second door sections, such that the completed Dutch door assembly, with end caps, has a height substantially equal to the height of the original composite door. In one embodiment, a first end cap is assembled with an interior end of the first door section by inserting retention tabs between the door skins and the corresponding sides of the core member and forcing an interior surface of the cover portion against an end surface of the core member and stiles (e.g., by striking with a mallet). In another embodiment, a first end cap is assembled with an interior end of the first door section using one or more fasteners. An adhesive may be applied to the cover portion interior surface, and/or to the end surface of the core member and/or stiles to facilitate secure attachment of the end cap. In the same manner, a second end cap is assembled with an interior end of the second door section.

Figure 16:
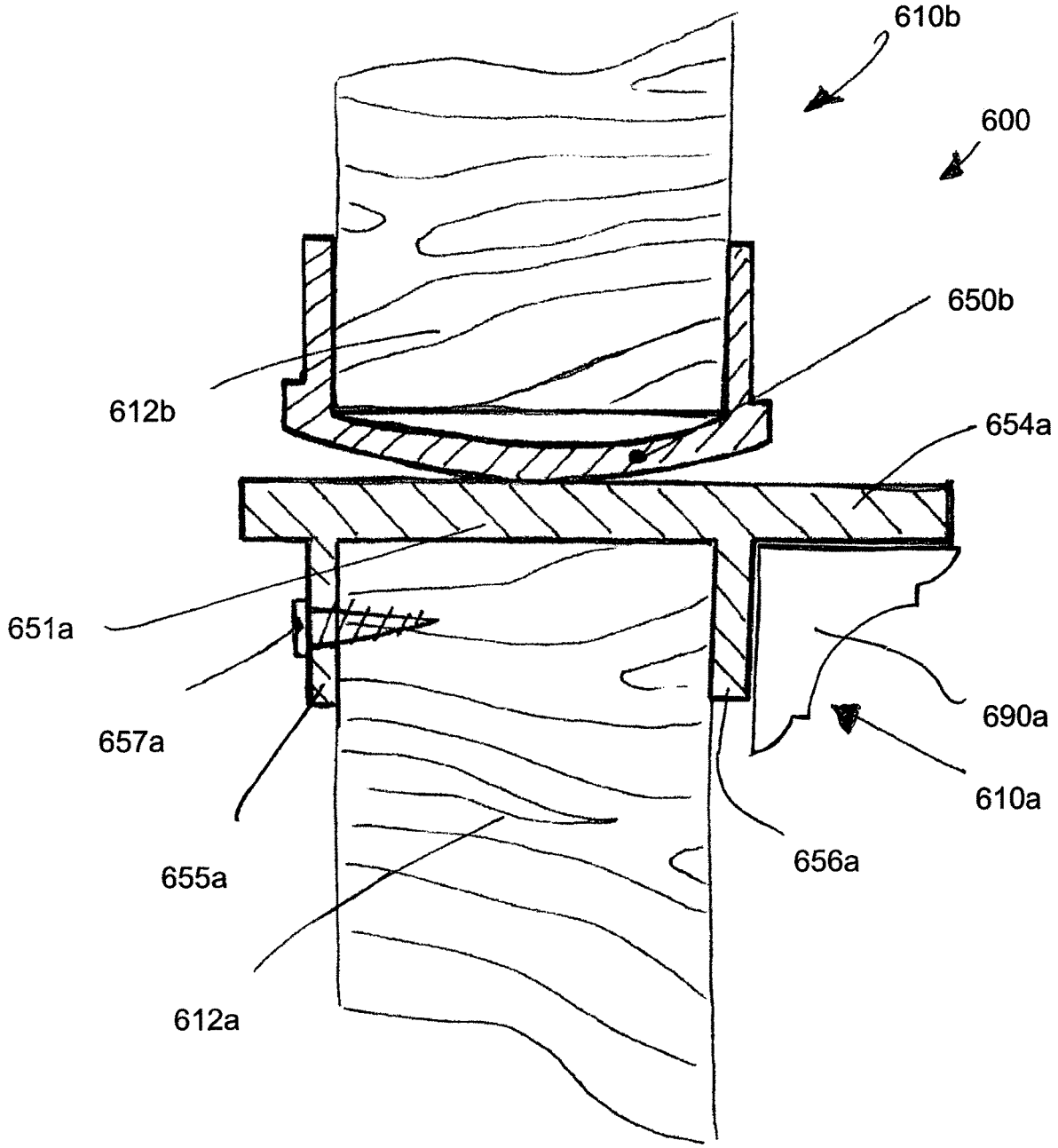
FIG. 16 is a partial side elevational view of another Dutch door assembly including a first door section provided with a first end cap and a second door section provided with a second end cap.

Other features and configurations may additionally or alternatively be provided. For example, an end cap for a Dutch door assembly may include a shelf attachment for the lower door section. FIG. 16 illustrates an exemplary Dutch door assembly 600 including a first (e.g., lower) door section 610*a* provided with a first end cap 650*a* secured to the core member 612*a* and a second (e.g., upper) door section 610*b* provided with a second end cap 650*b* secured to the core member 612*b*. The first end cap 650*a* includes a shelf portion 654*a* extending laterally outward of a cover portion 651*a* of the end cap. One or more brackets 690*a* may be installed between the shelf portion 654*a* and the door (or between the shelf portion and an overhang portion 656*a*, as shown) to provide support for the shelf portion. While any suitable arrangement may be used to attach the first end cap 650*a* to the first door section 610*a*, in the illustrated embodiment, a fastener 657*a* is installed through a mounting hole in opposite overhang portion 655*a*, and into the core member 612*a*, to anchor the end cap to the door section opposite the shelf portion.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A Dutch door assembly, comprising:

a first door section comprising:

a first composite door member including a first core member disposed between first and second end stiles, together defining a front door surface, a rear door surface, and an end surface, a front door skin secured to and substantially covering the front door surface, and a rear door skin secured to and substantially covering the rear door surface; and a first end cap including a first cover portion covering the end surface of the first composite door member and a first retention portion extending from the first cover portion into engagement with the first core member; and a second door section comprising:

a second composite door member including a second core member disposed between third and fourth end stiles, together defining a front door surface, a rear door surface, and an end surface, a front door skin secured to and substantially covering the front door surface, and a rear door skin secured to and substantially covering the rear door surface; and a second end cap including a second cover portion covering the end surface of the second composite door member and a second retention portion extending from the second cover portion into engagement with the second core member;

wherein the first end cap includes a first abutment portion contoured to engage a second abutment portion of the second end cap when the first and second door sections are in pivoted alignment; and wherein the second abutment portion includes an elongated gasket seal having a laterally outward facing portion that engages a laterally outward facing surface of a first stepped shoulder portion of the first abutment portion, and a vertically outward facing portion that extends vertically beyond a second stepped shoulder portion of the second abutment portion to engage a vertically outward facing surface of the first cover portion.

2. The Dutch door assembly of claim 1, wherein the elongated gasket seal comprises a weatherstrip gasket.

3. The Dutch door assembly of claim 1, wherein the elongated gasket seal comprises a flanged gasket assembled with a rabbeted groove in the second stepped shoulder portion.

4. The Dutch door assembly of claim 1, wherein each the first and second retention portions comprises an adhesive.

5. The Dutch door assembly of claim 1, wherein each of the first and second retention portions comprises at least one fastener secured to the corresponding core member.

6. The Dutch door assembly of claim 1, wherein the each of the first and second retention portions comprises at least one retention tab extending from the corresponding cover portion and into engagement with the corresponding core member.

7. The Dutch door assembly of claim 6, wherein the at least one retention tab is integral with the corresponding cover portion.

8. The Dutch door assembly of claim 6, wherein the at least one retention tab is assembled with the cover portion.

9. The Dutch door assembly of claim 6, wherein the at least one retention tab extends from the corresponding cover portion and is inserted between the corresponding core member and one of the corresponding front and rear door skins.

10. The Dutch door assembly of claim 6, wherein the at least one retention tab extends from the corresponding cover portion into gripping and interlocking engagement with the corresponding core member.

11. The Dutch door assembly of claim 6, wherein the at least one retention tab includes a barbed end portion.

12. The Dutch door assembly of claim 1, wherein each of the first and second core members comprises a polymeric foam.

13. A Dutch door assembly, comprising:

a first door section comprising:

a first composite door member including a first core member disposed between first and second end stiles, together defining a front door surface, a rear door surface, and an end surface, a front door skin secured to and substantially covering the front door surface, and a rear door skin secured to and substantially covering the rear door surface; and a first end cap including a first cover portion covering the end surface of the first composite door member and a first retention portion extending from the first cover portion into engagement with the first core member; and a second door section comprising:

a second composite door member including a second core member disposed between third and fourth end stiles, together defining a front door surface, a rear door surface, and an end surface, a front door skin secured to and substantially covering the front door surface, and a rear door skin secured to and substantially covering the rear door surface; and a second end cap including a second cover portion covering the end surface of the second composite door member and a second retention portion extending from the second cover portion into engagement with the second core member;

wherein the first end cap includes a first abutment portion contoured to engage a second abutment portion of the second end cap when the first and second door sections are in pivoted alignment; and wherein the first end cap further comprises a first overhang portion extending outward of the corresponding front door skin.

14. The Dutch door assembly of claim 13, wherein the first abutment portion comprises a rounded outer surface of the first cover portion.

15. The Dutch door assembly of claim 14, wherein the second abutment portion comprises a gasket seal.

16. The Dutch door assembly of claim 13, wherein the first abutment portion comprises a first stepped shoulder portion, and the second abutment portion comprises a second stepped shoulder portion in facing relationship with the first stepped shoulder portion.

17. The Dutch door assembly of claim 16, wherein the second abutment portion includes an elongated gasket seal assembled with the second cover portion for sealing engagement with the first stepped shoulder portion.

18. The Dutch door assembly of claim 17, wherein the elongated gasket seal includes a laterally outward facing portion that engages a laterally outward facing surface of the first stepped shoulder portion, and a vertically outward facing portion that engages a vertically outward facing surface of the first stepped shoulder portion.

19. The Dutch door assembly of claim 13, wherein the second end cap further comprises a second overhang portion extending outward of the corresponding front door skin.

20. A method of fabricating a Dutch door assembly, the method comprising:

providing first and second composite door members, each including a core member disposed between first and second end stiles, together defining a front door surface, a rear door surface, and an end surface, a front door skin secured to and substantially covering the front door surface, and a rear door skin secured to and substantially covering the rear door surface;

securing a first end cap with the end surface of first door member by engaging a retention portion of the first end cap with the core member of the first door member, such that a cover portion of the first end cap covers the end surface of the first door member; and securing a second end cap with the end surface of second door member by engaging a retention portion of the second end cap with the core member of the second door member, such that a cover portion of the second end cap covers the end surface of the second door member;

wherein the end cap of the first door section includes an abutment portion contoured to engage an abutment portion of the end cap of the second door section when the first and second door sections are in pivoted alignment;

wherein the retention portion of the first end cap comprises at least one retention tab having a barbed end portion with a sharp leading edge; and wherein engaging the retention portion of the first end cap with the core member of the first door member comprises piercing the core member of the first door member with the barbed end portion of the at least one retention tab.

* * * * *